US006725006B2

(12) United States Patent
Hosoya et al.

(10) Patent No.: US 6,725,006 B2
(45) Date of Patent: Apr. 20, 2004

(54) APPARATUS AND METHOD FOR IMAGE FORMATION WITH A LIQUID DEVELOPER

(75) Inventors: Masahiro Hosoya, Saitama-ken (JP); Hitoshi Yagi, Kanagawa-ken (JP); Yasushi Shinjo, Kanagawa-ken (JP); Haruhi Oh-Oka, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/460,182

(22) Filed: Jun. 13, 2003

(65) Prior Publication Data

US 2003/0206752 A1 Nov. 6, 2003

Related U.S. Application Data

(63) Continuation of application No. 09/974,787, filed on Oct. 12, 2001, now Pat. No. 6,600,890.

(30) Foreign Application Priority Data

Oct. 13, 2000 (JP) ..... 2000-313445

(51) Int. Cl.[7] ..... G03G 15/10

(52) U.S. Cl. ..... 399/237; 399/53; 399/57; 430/45; 430/117

(58) Field of Search ..... 399/53, 55, 56, 399/57, 58, 59, 62, 223, 237, 239, 240; 430/45, 47, 54, 112, 117

(56) References Cited

U.S. PATENT DOCUMENTS 4,660,503 A 4/1987 Jones (List continued on next page.)

OTHER PUBLICATIONS

Hitoshi Yagi, et al. Toshiba Corp. Japan, IS&T's NIP16: 2000 International Conference on Digital Printing Technologies, "Image–on–Image Color Process Using Liquid Toner"; pp. 246–250; Oct. 15–20, 2000.

*Primary Examiner*—Hoang Ngo

(74) *Attorney, Agent, or Firm*—Oblon, Spivak, McClelland, Maier & Neustadt, P.C.

(57) ABSTRACT

Image forming apparatus which form an image on a substrate and uses a liquid developer containing toner particles and a solvent. One embodiment includes a latent image retaining body, a first developing surface facing the latent image retaining body at a first development station, a latent image forming unit, and a second developing surface facing the latent image retaining body at a second development station. The latent image retaining body has a photosensitive layer which has a dielectric constant $\epsilon_P$ [$C^2/Nm^2$] and an average thickness $d_p$ [m]. The photosensitive layer retains an image developed by the first developing surface and a latent image comprising image and non-image regions formed by the latent image forming unit. The second developing surface is supplied with a developing electrical potential having an electrical potential difference ΔV from an electrical potential of non-image region of the latent image. The plurality of toner particles of the first liquid developer has a volume density $\rho_m$[$kg/m^3$], a surface density $m_r$[$kg/m^2$], a dielectric constant $\epsilon_r$ [$C^2/Nm^2$], an average radius r [m], and a density of electrical charge $q_r$[C/kg], and the image developed on the latent image retaining body by the first developing surface has an average thickness $d_r$ [m] at the second development station. The second liquid developer has an average thickness $d_t$ [m] at the second development station and a dielectric constant $\epsilon_t$ [$C^2/Nm^2$], wherein following equations are satisfied, $$1\times10^{-11}[N] \le \frac{4\pi r^3\rho_m q_r}{3}\left(-\frac{q_r m_r}{\varepsilon_r d_r}\left(d_r-\frac{1}{A}\frac{d_r}{m_r}\left(-\frac{\Delta V}{q_r}+\left(\frac{d_r}{2\varepsilon_r}+\frac{d_t}{\varepsilon_t}\right)m_r\right)\right)\right) \le 8\times10^{-9}[N],$$

$$\text{and } A=\frac{d_p}{\varepsilon_p}+\frac{d_r}{\varepsilon_r}+\frac{d_t}{\varepsilon_t}.$$

21 Claims, 14 Drawing Sheets

U.S. PATENT DOCUMENTS

| | | | |
|---|---|---|---|
| 5,557,377 | A | 9/1996 | Loewen et al. |
| 5,570,173 | A | 10/1996 | Nye et al. |
| 5,916,718 | A | 6/1999 | Kellie et al. |
| 6,018,636 | A | 1/2000 | Caruthers |
| 6,314,253 | B1 | 11/2001 | Hosoya et al. |

OTHER PUBLICATIONS

Masahiro Hosoya, et al., Toshiba Corp. The Annual Conference of the Imaging Society of Japan "Image–on–Image (=IOI) color process using liquid toner"; pp. 161–164; Jun. 12, 2000.

APPARATUS AND METHOD FOR IMAGE FORMATION WITH A LIQUID DEVELOPER

This application is a Continuation of application Ser. No. 09/974,787 Filed on Oct. 12, 2001 now U.S. Pat. No. 6,600,890

CROSS-REFERENCE TO RELATED APPLICATIONS

This application claims the benefit of priority from Japanese Patent Application No. 2000-313445, filed on Oct. 13, 2000, the entire contents of which are incorporated herein by reference.

BACKGROUND OF THE INVENTION

1. Field of the Invention

The present invention relates to a liquid developer image forming apparatus, which forms an image on a substrate using a liquid developer containing toner particles and a solvent. The present invention also relates to an image forming method using the liquid developer.

2. Discussion of the Background

An image forming apparatus using a liquid developer has promising advantages over an image forming apparatus using dry toner. One advantage arises due to the fact that the liquid developer contains a carrier solvent and toner particles, which have an average particle size in the sub-micrometer range, much smaller than the size of dry toner particles, whereby high image quality is preferably obtained. The liquid developer also decreases the amount of toner particles needed to develop images, while maintaining high image density. Therefore, liquid toners are economical in addition to enabling realization of fine texture printed images. The liquid developer also allows fixing of a developed image onto a final substrate at relatively low temperature and therefore is preferable from the standpoint of energy conservation.

On the other hand, the image forming apparatus using liquid developer has several features, which have discouraged its use. One such feature is unpredictable instability of developing characteristic that may in dependence or selection of values result from each several operating parameters controlling the development.

Multicolor image can be formed on a photosensitive body by developing each color image on top of other color image(s) through an Image-On-Image (IOI) process and transferred to a substrate, for example a paper receptor. The IOI process does not need a large transfer drum which transfer the image from the photosensitive body to the final substrate but only one photosensitive body or a smaller transfer drum whereby a simple and compact multicolor developing apparatus can be realized. The apparatus using the IOI process is also preferable for improving alignment between color images and high speed of the image forming because of easy image transfer to the final substrate.

Several image forming apparatuses using the dry toner through the IOI process have been researched and produced (See The Transactions of the Institute of Electronics, Information and Communication Engineers J67-C (12), p.970 (1984); Journal of the Imaging Society of Japan 26(2), p.107(1987); and Japan Hardcopy 89 p.163(1989)). However, those apparatuses had several essential problems to be resolved before realizing high quality of texture.

A first problem is that the dry toner layer on the photosensitive body may be so bulky as to scatter and absorb modulated light beams thereby bringing about poor light attenuation and uneven electric potential at charging and exposing steps for a next color image, thereby resulting in deterioration of quality. A second problem is that the previously formed image on the photosensitive body may be deteriorated and removed by the development of the next color image, so as to require non-contact developing with several restrictions on the developing condition. A third problem is that electrophoresis transfer cannot easily transfer at one time the multicolor image, which is exposed to corona ions and high efficiency and high quality of texture cannot be realized.

A liquid developer apparatus using the IOI process is also described in U.S. Pat. Nos. 4,660,503 and 5,557,377, however, no guidance for realizing stable high quality development is provided. Therefore a liquid developer image forming apparatus using the IOI process has not been known for practical use.

SUMMARY OF THE INVENTION

In various aspects, embodiments of the present invention provide image forming apparatuses and image forming methods which form an image on a substrate by using a liquid developer containing toner particles and a solvent.

According to a first aspect, one embodiment of the present invention provides a liquid developer image forming apparatus including a latent image retaining body, a first developing surface, a latent image forming unit, and a second developing surface. The latent image retaining body has a photosensitive layer having a relative dielectric constant $\epsilon_p$ [$C^2/Nm^2$] and an average thickness $d_p$ [m] and on which a latent image can be formed. The first developing surface faces the latent image retaining body at a first development station, and is supplied with an electrical potential for a first development. The first developing surface is configured to provide the first liquid developer to the latent image retaining body. The latent image forming unit also faces the latent image retaining body and is configured to form a second latent image comprising image and non-image regions on the photosensitive layer. The second developing surface also faces the latent image retaining body at a second development station and is supplied with an electrical potential for a second development which has an electrical potential difference $\Delta V$ from an electrical potential of the non-image region of the second latent image. The second developing surface is configured to provide the second liquid developer to the latent image retaining body, and the latent image retaining body supports the image of the first liquid developer and the second latent image. The plurality of toner particles of the first liquid developer at the second development station have a volume density of toner particles $\rho_m$ [$kg/m^3$], a surface density $m_r$ [$kg/m^2$], a relative dielectric constant $\epsilon_r$ [$C^2/Nm^2$], an average radius r [m], and a density of electrical charge $q_r$ [C/kg] at the second development station. The first liquid developer image has an average thickness $d_r$ [m] at the second development station and the second liquid developer has an average thickness $d_t$ [m] at the second development station, and a relative dielectric constant $\epsilon_t$ [$C^2/Nm^2$]; and the parameters satisfy following equations, $$1\times10^{-11}[N] \le \frac{4\pi r^3\rho_m q_r}{3}\left(-\frac{q_r m_r}{\varepsilon_r d_r}\left(d_r - \frac{1}{A}\frac{d_r}{m_r}\left(-\frac{\Delta V}{q_r} + \left(\frac{d_r}{2\varepsilon_r} + \frac{d_t}{\varepsilon_t}\right)m_r\right)\right)\right) \le 8\times10^{-9}[N],$$

$$\text{and } A = \frac{d_p}{\varepsilon_p} + \frac{d_r}{\varepsilon_r} + \frac{d_t}{\varepsilon_t}.$$

According to a second aspect, one embodiment of the present invention provides a liquid developer image forming apparatus comprising a latent image retaining body, a developing surface, and a squeezing surface. The latent image retaining body comprises a photosensitive layer configured to keep a latent image and having a relative dielectric constant $\epsilon_p$ and an average thickness $d_p$. The developing surface faces the latent image retaining body at a development station and is supplied with an electrical development potential. The developing surface is configured to provide the liquid developer to the latent image retaining body which supports the photosensitive layer on which is formed a latent image including image and non-image regions. The squeezing surface also faces the latent image retaining body at a squeezing station and is supplied with an electrical potential producing an electrical potential difference ΔV1 relative to the electrical potential of the non-image region of the photosensitive layer. The latent image retaining body supports an image of the liquid developer and the plurality of toner particles of the image having a relative dielectric constant $\epsilon_{0r}$, an average radius r, a density of electrical charge $q_{0r}$, a volume density of toner particles $p_{0m}$, and a surface density $m_{0r}$. The image at the squeezing station has an average thickness $d_{0r}$, and the liquid developer has an average thickness $d_t$ at the squeezing station, and a relative dielectric constant $\epsilon_t$. The parameters satisfy following equations, $$6\times10^{-11}[N] \le \frac{4\pi r^3\rho_{0m}q_{0r}}{3}\left(-\frac{q_{0r}m_{0r}}{\varepsilon_{0r}d_{0r}}\left(d_{0r}-\frac{1}{A}\frac{d_{0r}}{m_{0r}}\left(-\frac{\Delta V}{q_{0r}}+\left(\frac{d_{0r}}{2\varepsilon_{0r}}+\frac{d_t}{\varepsilon_t}\right)m_{0r}\right)\right)\right) \le 3\times10^{-9}[N], \text{ and } A=\frac{d_p}{\varepsilon_p}+\frac{d_{0r}}{\varepsilon_{0r}}+\frac{d_t}{\varepsilon_t}.$$

According to a third aspect, one embodiment of the present invention provides an image forming method comprising steps of providing a first liquid developer at a first development station on a latent image retaining body which has a photosensitive layer, forming a second latent image on the photosensitive layer, and providing a second liquid developer on the latent image retaining body at a second development station using a development surface. The first liquid developer comprises a solvent and a plurality of toner particles. The photosensitive layer retains an image of first liquid developer and a non-image region. The photosensitive layer has a relative dielectric constant $\epsilon_P$ [$C^2/Nm^2$] and an average thickness $d_p$ [m]. The second latent image has an image region and a non-image region. The toner particles of the image of first liquid developer at the second development station has a volume density $\rho_m$ [$kg/m^3$], a relative dielectric constant $\epsilon_r$ [$C^2/Nm^2$], an average radius r[m], a density of electric charge $q_r$ [C/kg], and a surface density $m_r$ [$kg/m^2$]. The first image of the first liquid developer on the photosensitive layer has an average thickness $d_r$ [m], and the electrical potential of the non-image region of the second latent image has an electrical potential difference ΔV [V] relative to the electrical potential of the development surface. The second liquid developer has an average thickness $d_t$ [m] at the second development station and a relative dielectric constant $\epsilon_t$ [$C^2/Nm^2$]. Those parameters satisfy following equations.

$$1\times10^{-11}[N] \le \frac{4\pi r^3\rho_m q_r}{3}\left(-\frac{q_r m_r}{\varepsilon_r d_r}\left(d_r-\frac{1}{A}\frac{d_r}{m_r}\left(-\frac{\Delta V}{q_r}+\left(\frac{d_r}{2\varepsilon_r}+\frac{d_t}{\varepsilon_t}\right)m_r\right)\right)\right) \le 8\times10^{-9}[N], \text{ and } A=\frac{d_p}{\varepsilon_p}+\frac{d_r}{\varepsilon_r}+\frac{d_t}{\varepsilon_t}.$$

According to a fourth aspect, one embodiment of the present invention provides an image method comprising steps of developing a latent image of a photosensitive layer with a liquid developer containing a solvent and a plurality of toner particles, and squeezing the solvent formed on the latent image retaining body by using a squeezing surface at a squeezing station. The photosensitive layer is configured to keep a latent image and has a relative dielectric constant $\epsilon_p$ [$C^2/Nm^2$] and an average thickness $d_p$ [m]. The squeezing surface is supplied with a squeezing electrical potential having an electrical potential difference ΔV1 [V] relative to an electrical potential of the non-image region of the photosensitive layer and the plurality of toner particles of the image have a relative dielectric constant $\epsilon_{0r}$ [$C^2/Nm^2$], an average radius r [m], a density of electrical charge $q_{0r}$ [C/kg], a volume density of toner particles $\rho_{0m}$ [$kg/m^3$], and a surface density $m_{0r}$ [$kg/m^2$]. The image at the squeezing station has an average thickness $d_{0r}$ [m] at the squeezing station, and the liquid developer has an average thickness $d_t$ [m] at the squeezing region, and a relative dielectric constant $\epsilon_t$ [$C^2/Nm^2$]. The parameters satisfy following equations, $$6\times10^{-11}[N] \le \frac{4\pi r^3\rho_{0m}q_{0r}}{3}\left(-\frac{q_{0r}m_{0r}}{\varepsilon_{0r}d_{0r}}\left(d_{0r}-\frac{1}{A}\frac{d_{0r}}{m_{0r}}\left(-\frac{\Delta V}{q_{0r}}+\left(\frac{d_{0r}}{2\varepsilon_{0r}}+\frac{d_t}{\varepsilon_t}\right)m_{0r}\right)\right)\right) \le 3\times10^{-9}[N], \text{ and } A=\frac{d_p}{\varepsilon_p}+\frac{d_{0r}}{\varepsilon_{0r}}+\frac{d_t}{\varepsilon_t}.$$

BRIEF DESCRIPTION OF THE DRAWINGS

A more complete appreciation of the invention and many of the attendant advantages thereof is readily obtained as the state becomes better understood by reference to the following detailed description when considered in connection with the accompanying drawings, wherein.

DETAILED DESCRIPTION OF THE PREFERRED EMBODIMENTS

Figure 1:
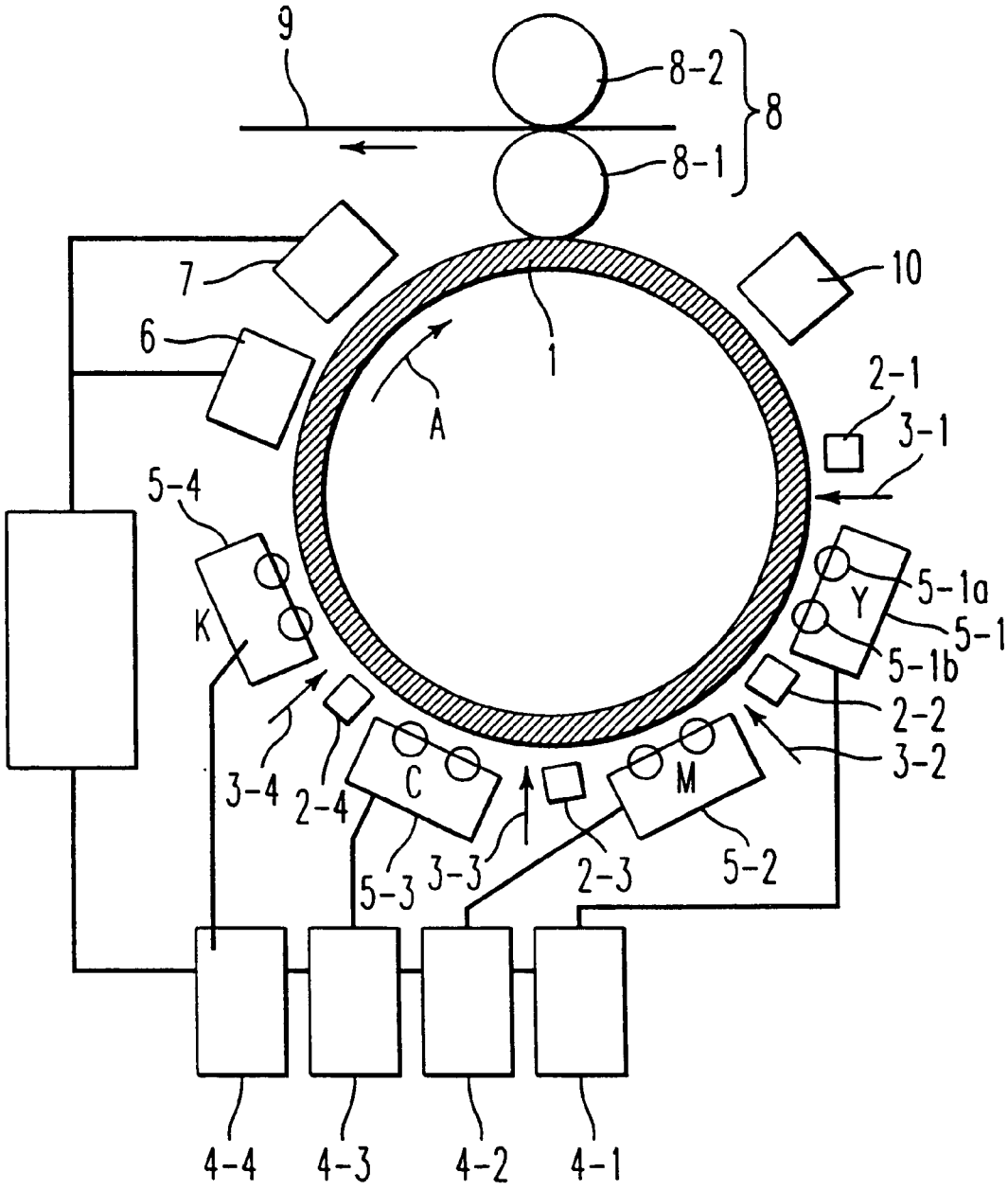
FIG. 1 is a cross-sectional view of a liquid developer image forming apparatus according to a first embodiment of the present invention.

Referring now to the drawings, where like reference numerals identify the same or corresponding parts throughout the several views, FIG. 1 is a cross-sectional view of a liquid developer image forming apparatus according to a first embodiment of the present invention, including a latent image retaining body 1, a first charging unit 2-1, a first exposing unit which applies a modulated light beam 3-1 to the latent image retaining body 1, and a first developing unit 5-1 which has a first developing roller 5-1*a*, a first squeezing roller 5-1*b*, and a first housing configured to hold a first color liquid developer. Thus, in the first embodiment, there is provided a first color unit including the first charging unit 2-1, the first exposing unit, and the first developing unit 5-1 configured to form a first color image on the latent image retaining body 1.

The liquid developer image forming apparatus of FIG. 1 also includes second through fourth color units. The second color unit includes a second charging unit 2-2, a second exposing unit which applies a modulated light beam 3-2 to the latent image retaining body 1, and a second developing unit 5-2 which has a second developing roller, a second squeezing roller, and a second housing to hold a second color liquid developer. The third color unit includes a third charging unit 2-3, a second exposing unit which applies a modulated light beam 3-3 to the latent image retaining body 1, and a third developing unit 5-3 which has a third developing roller, a third squeezing roller, and a third housing to hold a third color liquid developer. The fourth color unit includes a fourth charging unit 2-4, a fourth exposing unit which applies a modulated light beam 3-4 to the latent image retaining body 1, and a fourth developing unit 5-4 which has a fourth developing roller, a fourth squeezing roller, and a fourth housing to hold a fourth color liquid developer.

Each of the developing units 5-1, 5-2, 5-3, and 5-4 contains a different liquid developer. The liquid developers contain a solvent and toner particles, and the toner particles may contain polymer and color pigments. Various color configurations of first through fourth liquid developers may be well known in the art to be employed in this embodiment. One example of a color configuration of the first through fourth liquid developers is Yellow (Y), Magenta (M), Cyan (C), and Black (K). Although the four-color developing units are shown in FIG. 1, the number of units may also be changed to provide an appropriate image.

The liquid developer image forming apparatus of FIG. 1 also includes first through fourth liquid developer containers 4-1, 4-2, 4-3, and 4-4, each of which is coupled to a corresponding of first through fourth developing units 5-1, 5-2, 5-3, and 5-4, and provides a liquid developer to the corresponding developing unit.

The liquid developer image forming apparatus of FIG. 1 also includes a solvent suction unit 6, a drying unit 7, and a transfer unit 8 including an intermediate transfer roller 8-1 and a back-up roller 8-2 which support a final recepter. The solvent suction unit 6 and the drying unit 7 are coupled to each of the liquid developer containers 4-1, 4-2, 4-3, and 4-4 for providing collected solvent to each of the liquid developer container 4-1, 4-2, 4-3, and 4-4. The transfer unit 8 may include only the back-up roller 8-2 and the image formed on the latent image retaining body 1 is directly transferred to the paper receptor 9 supported between the latent image retaining body 1 and the back-up roller 8-2.

The latent image retaining body 1 rotates in the direction of arrow A of FIG. 1 and may be a photosensitive drum that includes a photosensitive layer covering a drum shape conductive substrate. The photosensitive layer may include organic or amorphous silicon material. A photosensitive belt having a photosensitive layer on a substrate belt may also be used as a latent image retaining body 1. The latent image retaining body 1 has an effective surface that is the whole outer surface of latent image retaining body 1 or a part of whole outer surface of latent image retaining body outside its sleeve regions at the edges of the body 1.

The first charging unit 2-1 uniformly charges the effective surface of latent image retaining body 1. Each of the first through fourth charging units 2-1, 2-2, 2-3, and 2-4 may be a corona charging unit, a scorotron charging unit, a brush charging unit, a roller charging unit, or any other charging unit which is known in the art or equivalent thereto.

The charged effective surface of photosensitive layer of latent image retaining body 1 receives the modulated light beam 3-1 applied by the exposing unit, whereby a latent image comprising an image area and a non-image area is formed on the effective surface of photosensitive layer of latent image retaining body 1. The modulated light beams 3-1, 3-2, 3-3, and 3-4 may be infrared laser beams or other equivalent light beams well known in the art. Through a discharged area development (reverse development), the image area corresponds to a region exposed to the modulated light beam, and the non-image area corresponds to a region not exposed to the modulated light beam. Through a charged area development, the image area corresponds to a region not exposed to the modulated light beam, and the non-image area corresponds to a region exposed to the modulated light beam.

The latent image formed effective surface of photosensitive layer is moved to a first development station by the rotation of the latent image retaining body 1. The first development station is located where the latent image retaining body 1 faces the first developing roller 5-1*a* and the latent image formed on the effective surface of latent image retaining body 1 is developed through supply of first liquid developer by the developing roller 5-1*a*. The developing roller 5-1*a* is supported to rotate by the developing unit 5-1 and the roller 5-1*a* contacts the first color liquid developer in the first housing of first developing unit 5-1, whereby the rotating developing roller 5-1*a* supplies the first liquid developer to the effective surface from the first housing. The developing roller 5-1*a* has a developing electrode (not shown), which forms an electrical potential difference between the roller 5-1*a* and the effective surface of latent image retaining body 1, thereby to accelerate movement of the charged toner particles to the effective surface of latent image retaining body 1.

The solvent of liquid developers usually contains insulating liquid hydrocarbon, such as "ISOPAR™" sold by Exxon. To develop the latent image on the effective surface of photosensitive layer, charged toner particles having the same or opposite electrical polarity to that of the latent image formed on the effective surface of latent image retaining body 1 may be used. A reverse development in which the toner particles are charged opposite in electrical polarity to that of the photosensitive layer is preferable.

The first squeezing roller 5-1*b* is supported to rotate by the first developing unit 5-1 and reduces the amount of solvent of the first liquid developer on the effective surface of latent image retaining body 1.

The developed image of first liquid developer is supported by the effective surface and moved to a second charging region by the rotation of latent image retaining body 1. The first developed image and the effective surface of latent image retaining body 1 are uniformly charged by the second charging unit 2-2 at the second charging region, where the effective surface of latent image retaining body 1 faces the second charging unit 2-2.

The uniformity of electrical potential of secondly charged effective surface is usually dependent on properties of the charging units 2-2 and the latent image retaining body 1, and on a process speed (a rotating speed of the latent image retaining body 1), however, an electric potential difference between the image and non-image areas of first developed image normally decreases to about 20–200 Volts after the second charging step.

The charged effective photosensitive layer of latent image retaining body 1 receives the light beam 3-2 at a second exposing region and is formed with a second latent image. The second latent image on the effective surface of latent image retaining body 1 is moved to a second development station, where the latent image retaining body 1 faces the developing roller 5-2*a* and is developed by the second developing roller which is configured the same as the first developing roller 5-1*a*. The effective surface of latent image retaining body 1 is moved to a second squeezing station, where the latent image retaining body 1 faces the second squeezing roller 5-1*b*, and the solvent on the effective surface of latent image retaining body 1 is reduced by the squeezing roller 5-1*b*, which has a similar structure as that of the first squeezing roller 5-2*b*.

Following in the same manner, the third and fourth units form respective color images on the effective surface of latent image retaining body 1 that supports the previously formed first and second color images, whereby the multi-color image is formed on the effective surface of latent image retaining body 1.

The multi-color image on the effective surface is moved to a first transfer station, where the latent image retaining body 1 faces the intermediate transfer roller 8-1, and transferred to the intermediate transfer roller 8-1 from the effective surface of latent image retaining body 1. The multi-color image is then transferred to the paper receptor 9 at a second transfer station, where the intermediate transfer roller 8-1 faces a back-up roller 8-2.

The transfer unit 8 may be a corona transfer unit or a roller transfer unit that utilizes electrophoresis. The transfer unit 8 may also be a pressure and/or a heat transfer unit. Other transfer methods known in the art may be used to facilitate the transfer of multi-color image from the latent image retaining body 1 and to a final receptor.

If pressure and heat transfer are employed at the first transfer station, the multi-color image may be preferably in a solvent reduced state, which may consist of solvent of about 30 weight percent or less and solid of about 70 weight percent or more.

To obtain the solvent reduce multi-color image, the apparatus includes a solvent suction unit 6 and a drying unit 7 that are disposed between the fourth developing unit 5-4 and the intermediate transfer roller 8-1 and face the latent image retaining body 1.

The solvent suction unit 6 may include a styrene foam roller that contacts or is disposed adjacent to the effective surface of latent image retaining body 1, whereby the styrene foam quickly absorbs the solvent on the effective surface. Other roller materials known in the art for the solvent suction unit 6 may be alternatively used. While the drying unit 7 may be omitted depending on the characteristic of the solvent used, a process temperature, etc, it is appropriate to reduce considerably solvent from the effective surface of latent image retaining body 1.

Figure 2:
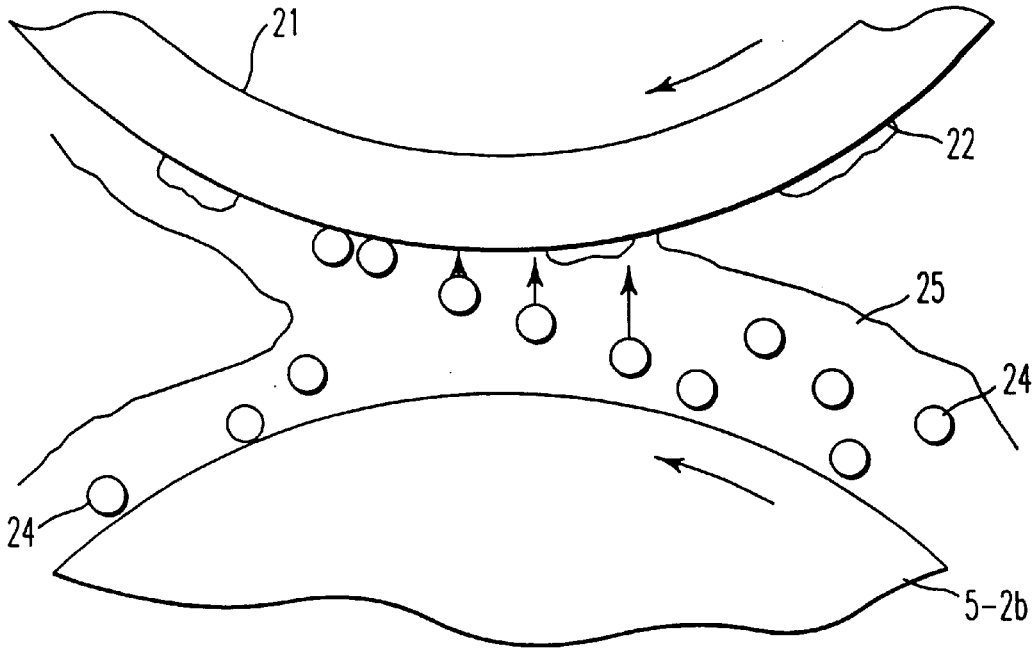
FIG. 2 is a diagram of a development station of the liquid developer image forming apparatus according to the first embodiment of the present invention.

Further to the advantages of the IOI process, the wet IOI process has number of advantages, several of which are listed below:

A. The IOI process can obtain high texture image because of using very fine toner particles that have an average diameter of around 1 micrometer or less;

B. The toner layer of the previously developed color image on the effective surface of latent image retaining body 1 is very thin (about 1/10 of that of dry toner), thereby to reduce disturbance of the charging and exposing for next color image;

C. FIG. 2 is a diagram at the second development station, where the effective surface of the latent image retaining body 1 faces the second developing roller 5-2*b*. The second developing roller 5-2*b* rotates in the direction of the arrow shown in FIG. 2 and provides the second color liquid developer including the solvent 25 and toner particles 24. The first image 22, shown in FIG. 2, is in a solvent reduced state reduced by the first squeezing roller 5-1*b*, and the toner particles in the solvent reduced state flock together by cohesion force and stick to the image area of the effective surface of the latent image retaining body 1, whereby the first image may not be removed through the development of the second color image; and D. The solvent suction unit 6 and the drying unit 7 may be effective to prevent a solvent leakage from the liquid developer image forming apparatus, thereby to avoid damage to the circumambient environment.

Additional advantages accrue to the wet IOI process of the present invention, and are next discussed.

1. Spectroscopic Permeability of the Toner Layer

Figure 3A:
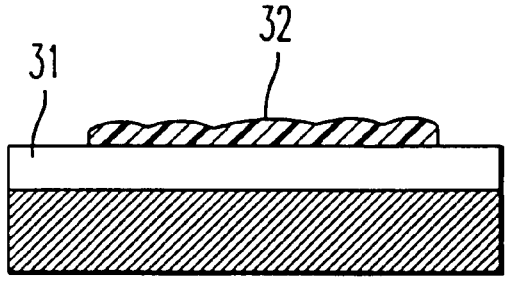
FIG. 3A is a cross-sectional view of an image of liquid developer formed on a photosensitive layer.
Figure 3B:
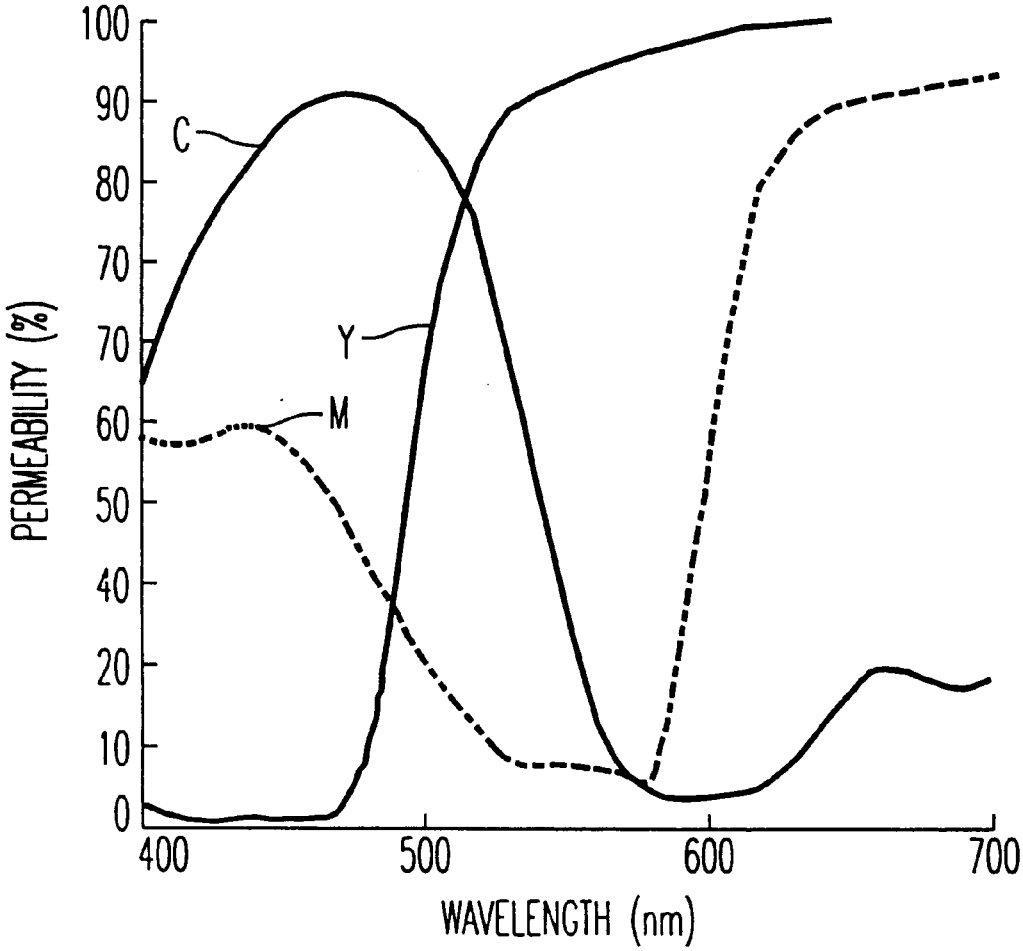
FIG. 3B is a graph showing a change of permeability [%] relative to wavelength [nm] of a liquid toner image on the photosensitive layer according to the first embodiment of the present invention.
Figure 4A:
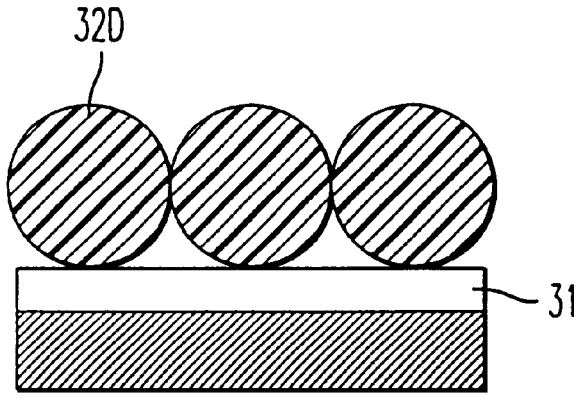
FIG. 4A is a cross-sectional view of an image of dry toner formed on a photosensitive layer.
Figure 4B:
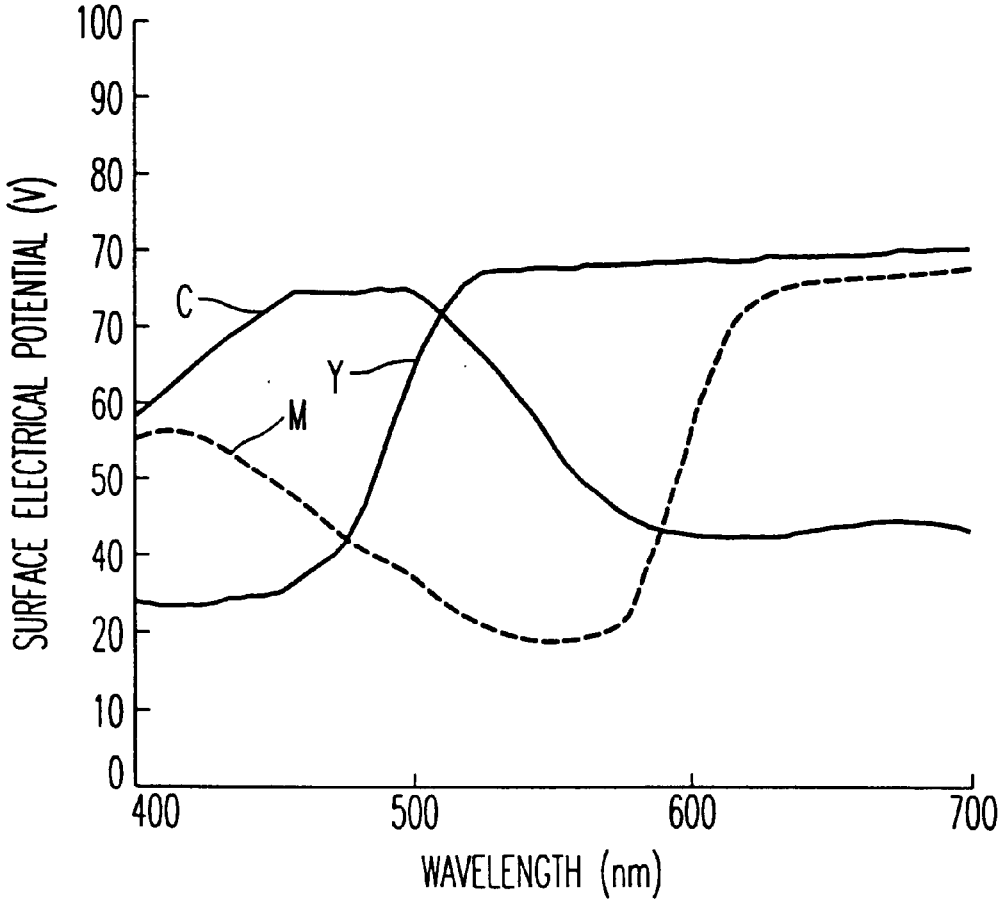
FIG. 4B is a graph showing a change of permeability [%] relative to wavelength [nm] of a dry toner image on the photosensitive layer.

FIGS. 3A and 3B respectively are a cross-sectional view and a graph to explain a change of permeability [%] relative to wavelength [nm] of a liquid developer image on the effective surface of latent image retaining body 1. FIGS. 4A and 4B are respectively a cross-sectional view and a graph to explain a change of permeability [%] relative to a wavelength [mn] of a dry toner image formed on the effective surface of latent image retaining body 1.

The toner layer 32L that contains the toner particles of liquid developer and is formed on the effective surface 31 of latent image retaining body 1 has a spectroscopic characteristic substantially equal to that of the pigments. When applied with a light beam whose wavelength ranges from about 680 nanometers to 780 nanometers is applied to the three color images, the spectroscopic permeability of the magenta (M) image is 90% or more. The spectroscopic permeability of the yellow (Y) image is almost 100%. The cyan (C) image tends to absorb the light beam of same wavelength range, however, an improved image for the successive color image may be obtained by implementing an appropriate image processing for a successive color image.

Spectroscopic permeability of dry toner image 32D of the magenta and yellow colors in FIG. 4 are both 70% or less.

2. Charging and Attenuation Characteristic of the Image Area

Figure 5A:
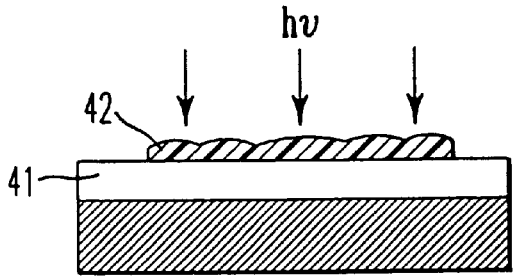
FIG. 5A is a cross-sectional view of an image of liquid developer formed on a photosensitive layer.
Figure 5B:
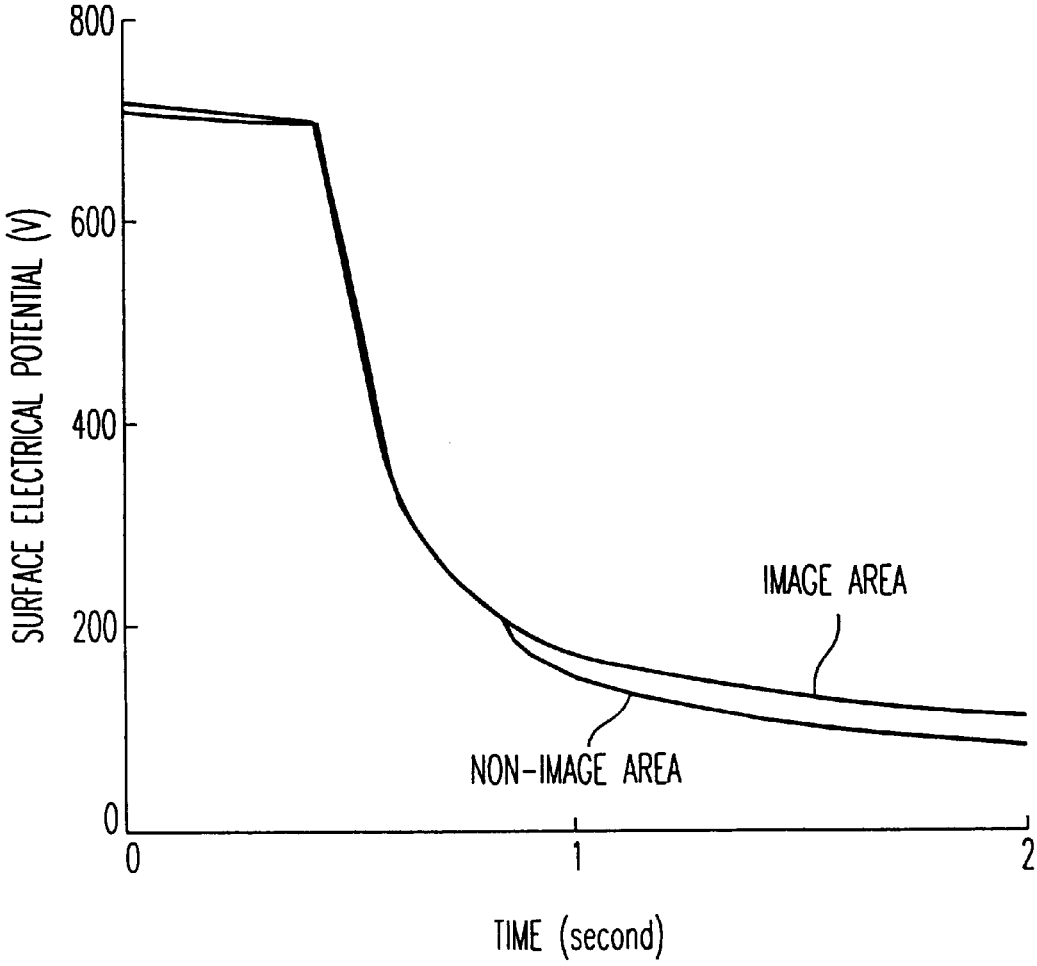
FIG. 5B is a graph showing changes of surface electrical potential [V] of the photosensitive body with the passage of time according to the first embodiment of the present invention.
Figure 6A:
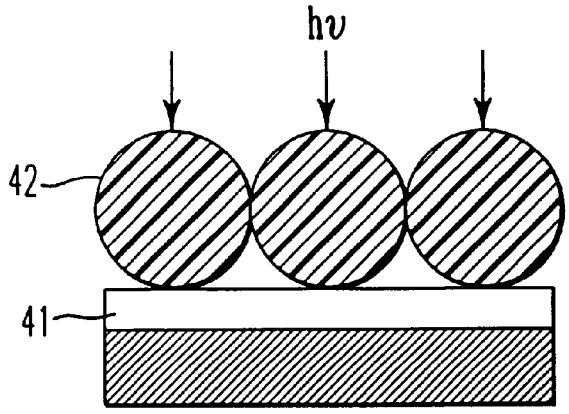
FIG. 6A is a cross-sectional view of an image of dry toner formed on a photosensitive layer.
Figure 6B:
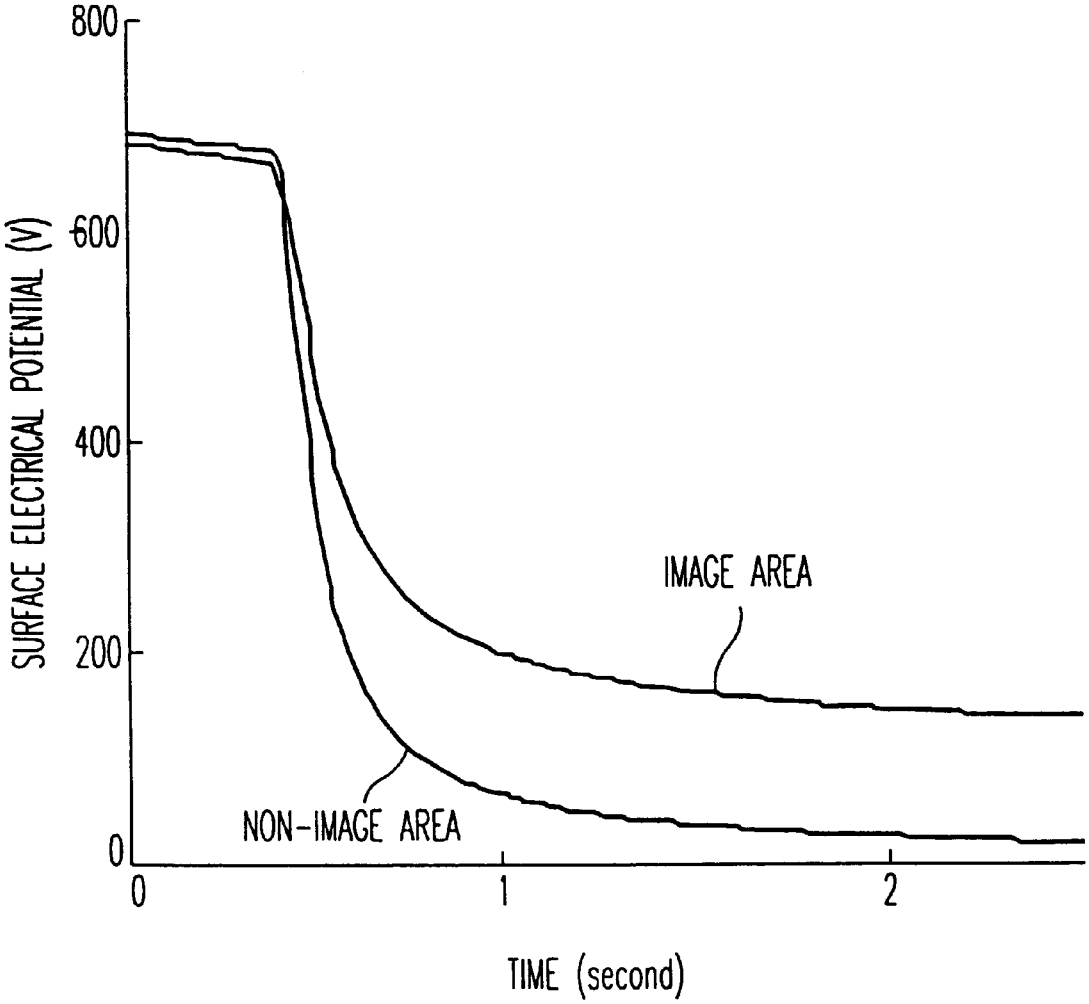
FIG. 6B is a graph showing changes of surface electrical potential [V] of a photosensitive body of an image forming apparatus using dry toner with the passage of time.

FIGS. 5A and 5B respectively are a cross sectional view and a graph to explain a change of surface electrical potential [V] of a photosensitive body with the passage of time according to the first embodiment of the present invention. FIGS. 6A and 6B respectively are a cross-sectional view and a graph to explain a change of surface electrical potential [V] of a photosensitive body of a dry toner image forming apparatus with the passage of time.

After the magenta image 42L formed on the effective surface 31 of latent image retaining body 1 is charged for a successive color image by the third charging unit 2-3, the image area, where the magenta image 42L is formed, and the non-image area, where the magenta image 42L is not formed, of the effective surface of the latent image retaining body 1 have surface potential voltage of about 720 [V]. After the effective surface of the latent image retaining body 1 receives the light beam 3-3 for the successive color image, surface electrical potential of both image and non-image areas decreases and a maximum difference between the surface electrical potentials between the both areas is around 30 [V]. On the other hand, a magenta color image of dry toner 42D tends to shield the light beam, whereby a maximum difference between the surface electrical potentials of an image and a non-image area is around 150 [V]. Such small difference of surface electrical potentials between the image and non-image areas of liquid developer is appropriate to obtain a sharp successive color image.

Figure 7:
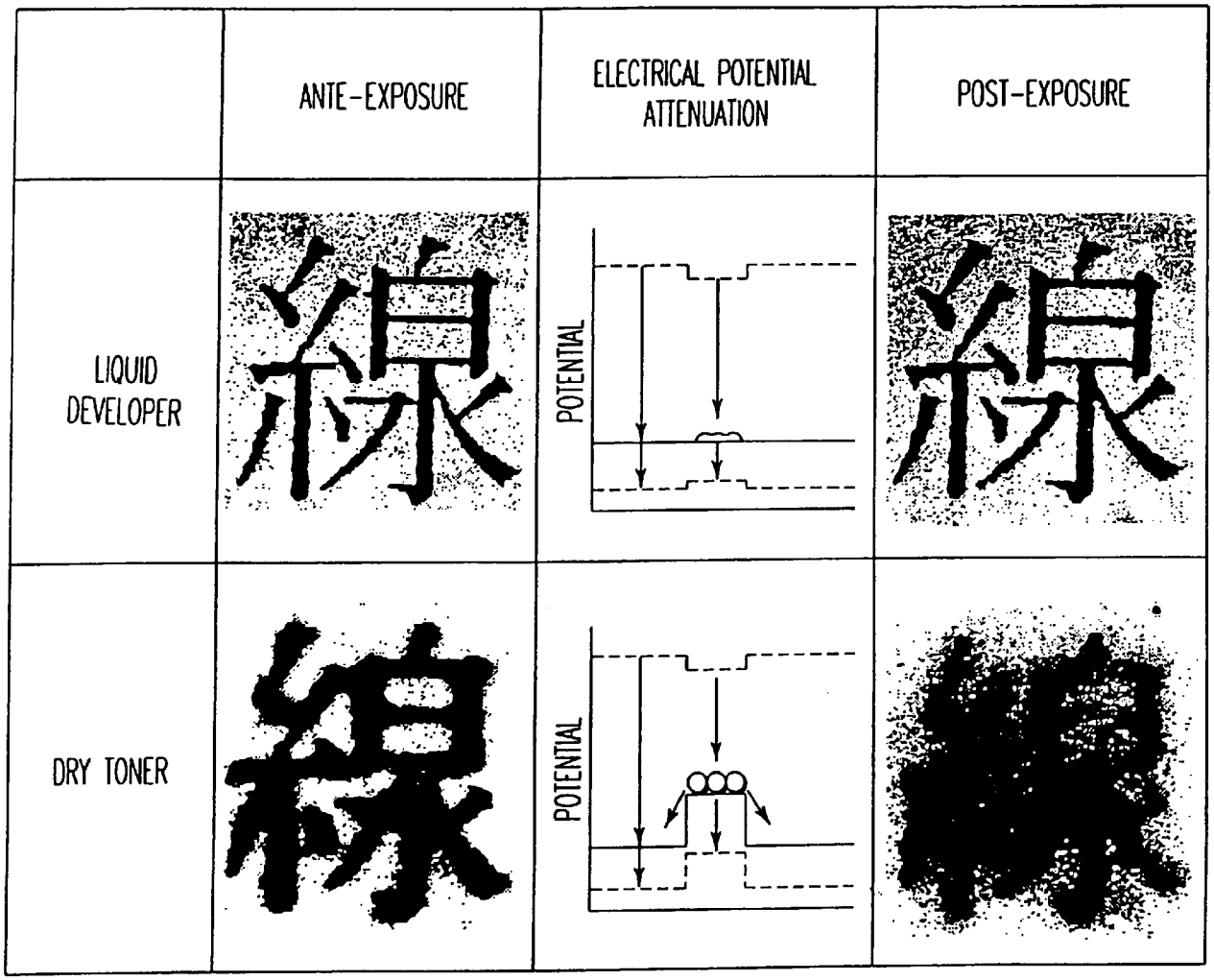
FIG. 7 is a diagram for explaining advantages of the liquid developer image forming apparatus according to the first embodiment of the present invention.

3. Change of Texture Through an Exposure to a Light Beam of a Successive Color Image FIG. 7 is a diagram for explaining advantages of the liquid developer image forming apparatus according to the first embodiment of the present invention. In the diagram, magenta images of both liquid developer and dry toner respectively ante-exposure and post-exposure are shown. Diagrams in FIG. 7 also show an electrical potential attenuation of the effective surface of latent image retaining body 1.

Although there is substantial change between the dry toner images of ante-exposure and post-exposure, there is no substantial change between the liquid developer images of ante-exposure and post-exposure of FIG. 7. The electrical potential attenuation of FIG. 7 shows small potential difference between the image and non-image areas of liquid developer through the exposure, while there is an electrical potential difference of about 150 V or more between the exposed image and non-image area of the magenta dry toner. The electrical potential difference may cause a scattering of dry toner particles and distortion of image.

4. Preservation of High Texture Image at Successive Stages

Figure 8:
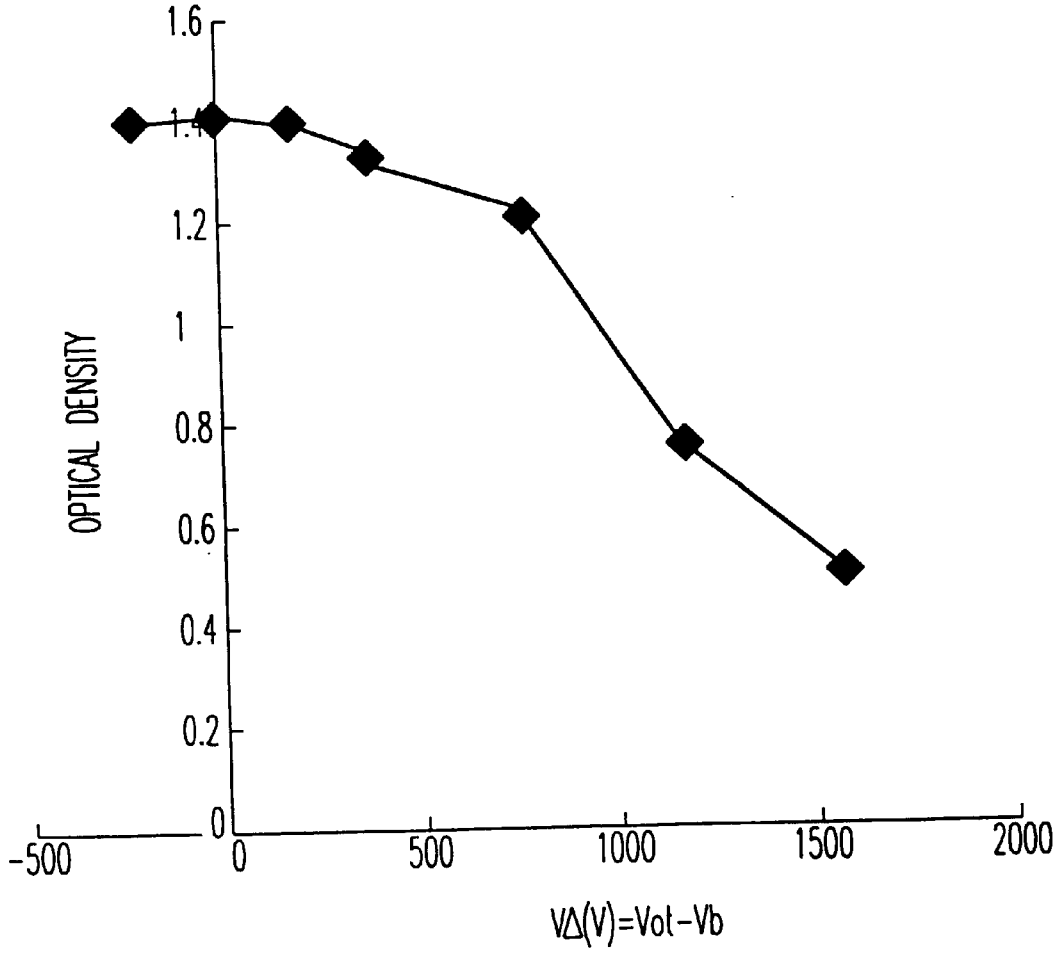
FIG. 8 is a graph for explaining a characteristic of the liquid developer image forming apparatus according to the first embodiment of the present invention.

The toner particles of first color image may be removed from the latent image retaining body 1 at the second development station because of electrical potential difference applied between the image region of photosensitive layer and the second squeezing surface, and toner particles may be mixed to the second color liquid developer. FIG. 8 is a graph for explaining a removal of toner images from the latent image retaining body. The vertical axis of this graph corresponds to optical density of first color image after the image has passed the second development station and the horizontal axis of the graph correspond to an electrical potential difference ΔV [V] between an electrical potential of image regions of the first color (non-image region of second color) $V_{0t}$ and an electrical potential of a developing roller $V_b$. When the electrical potential difference ΔV is lower than 200 V, the image may keep its image density and the removal of toner images may be prevented, because the first squeezing of the first liquid developer and the second charging promote a cohesion force implemented between the toner particles in the image region.

To obtain those preferable and stable characteristics, several conditions relating to liquid development IOI process described below should be adjusted.

According to an early theory of liquid development, the development mechanism was studied under conditions of uniform electrical field application to toner particles in a carrier solvent and an effect of viscous drag of carrier solvent, and a unlimited supply of toner particles at the development station. See Kurita et al., Journal of the Imaging Society of Japan, 3(3), p. 26(1961); R. M. Schaffert, Electrophotography, FocalPress, London, p.562(1975). However, counter ions that are charged to counter polarity of the toner particles are present in the liquid developer and have some effect on the image texture and other characteristics should also be taken into account.

In the first embodiment, an electric charge of each toner particles, a distribution of counter ions and its change with time upon passage of counter ions are taken into account and a continuous Poisson's equation is analyzed as follows.

Figure 9:
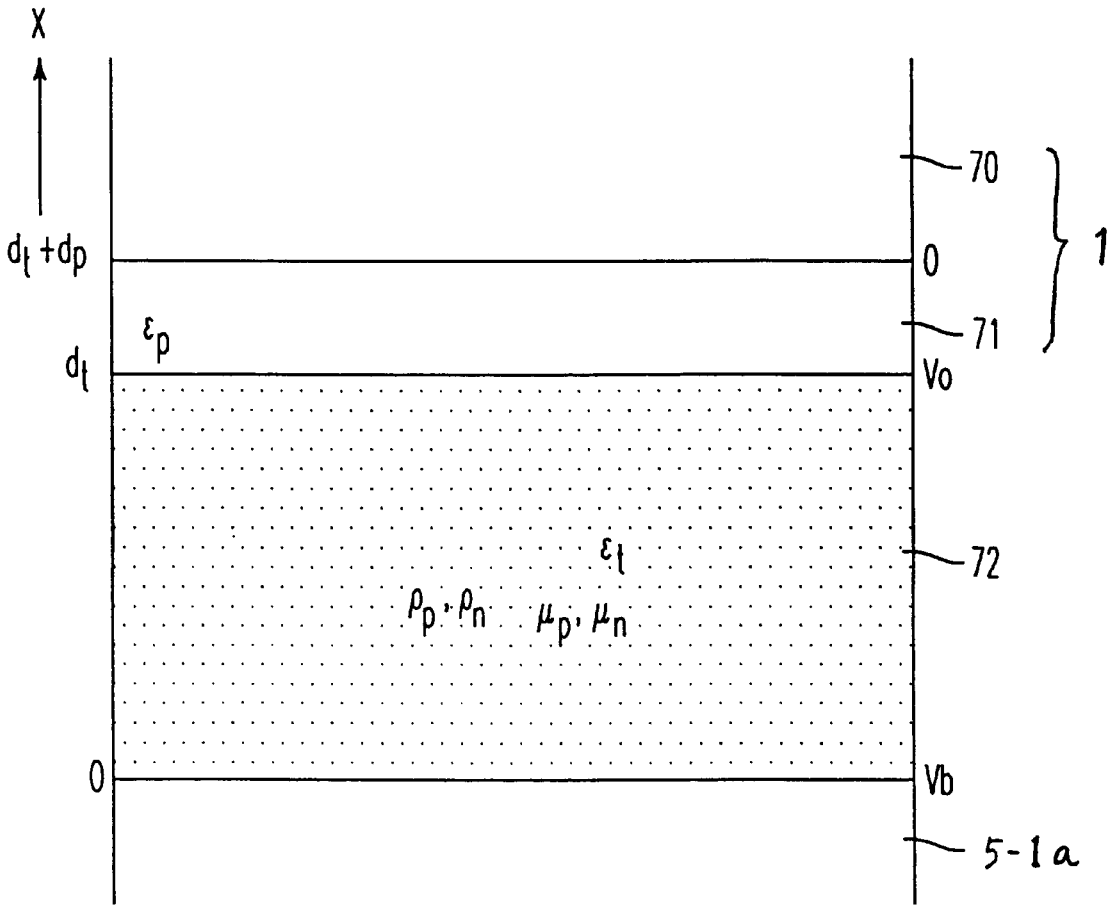
FIG. 9 is a diagram for explaining a theoretical analysis of a development using the liquid developer according to the first embodiment of the present invention.

FIG. 9 is a cross sectional view of a development station where the latent image retaining body 1 comprising a conductive base layer 70 and a photosensitive surface 71 faces a developing roller 5-1*a*.

The photosensitive layer 71 is charged by the charging unit 2-1 and has a surface electrical potential $V_0$[V]. The electric charge $\rho_P$[C/kg] of toner particles in a liquid developer 72 and the surface electrical potential of the photosensitive layer 71 are set to be positive. There are counter ions $\rho_n$[C/kg] in the liquid developer 72, and the counter ions are equal to the electric charge of toner particles $\rho_p$[C/kg] at an initial stage of development.

The toner particles move from the developing roller 5-1*a* to the photosensitive layer 71 at a speed $\mu_p$[$m^2$/V•s] by an effect of electrical field E which is formed by the surface potential of photosensitive layer $V_0$ and the surface potential $V_b$ of the developing roller 73.

Time and spatial distribution of density of electrical charge is expressed by continuous equations (1) and (2), and Poisson's equation (3). In all equations below, t [second] is a developing time, and x[m] is distance from the surface of developing roller in a direction to the photosensitive roller.

$$\frac{\partial \rho_P}{\partial t} = -\frac{\partial(\mu_P \rho_P E)}{\partial x} \tag{1}$$

$$\frac{\partial \rho_n}{\partial t} = -\frac{\partial(\mu_n \rho_n E)}{\partial x} \tag{2}$$

$$\frac{\partial E}{\partial x} = \frac{\rho_P + \rho_n}{\varepsilon_t} \tag{3}$$

As an initial condition, the volume electron density of toner particle $|P_o|$ is equal to that of counter ion $|-P_o|$, and the electric field E is equal to a result of Poisson's equation, $E=V_b/\epsilon_t\ (d_p/\epsilon_p+d_t/\epsilon_t)$, wherein $\epsilon_t$ is the relative dielectric constant of the carrier solvent, $d_t$ is an average thickness of the carrier solvent, $\epsilon_p$ is the relative dielectric constant of the photosensitive layer, $P_o=1.54$ [c/m$^3$], $\epsilon_t=2.03\ \epsilon_o$, $\epsilon_p=12\ \epsilon_o$, $d_t=30$ [$\mu$m], $\mu_p=4\times10^{-10}$ [m$^2$/V sec], $\mu_n=4\times10^{-11}$ [m$^2$/V sec], $t_d=48$ [msec].

Under this condition, toner particles reached and adhered to the surface of photosensitive layer 71 change the surface electrical potential $V_0$ and the equations are analyzed by a finite difference method.

Figure 10:
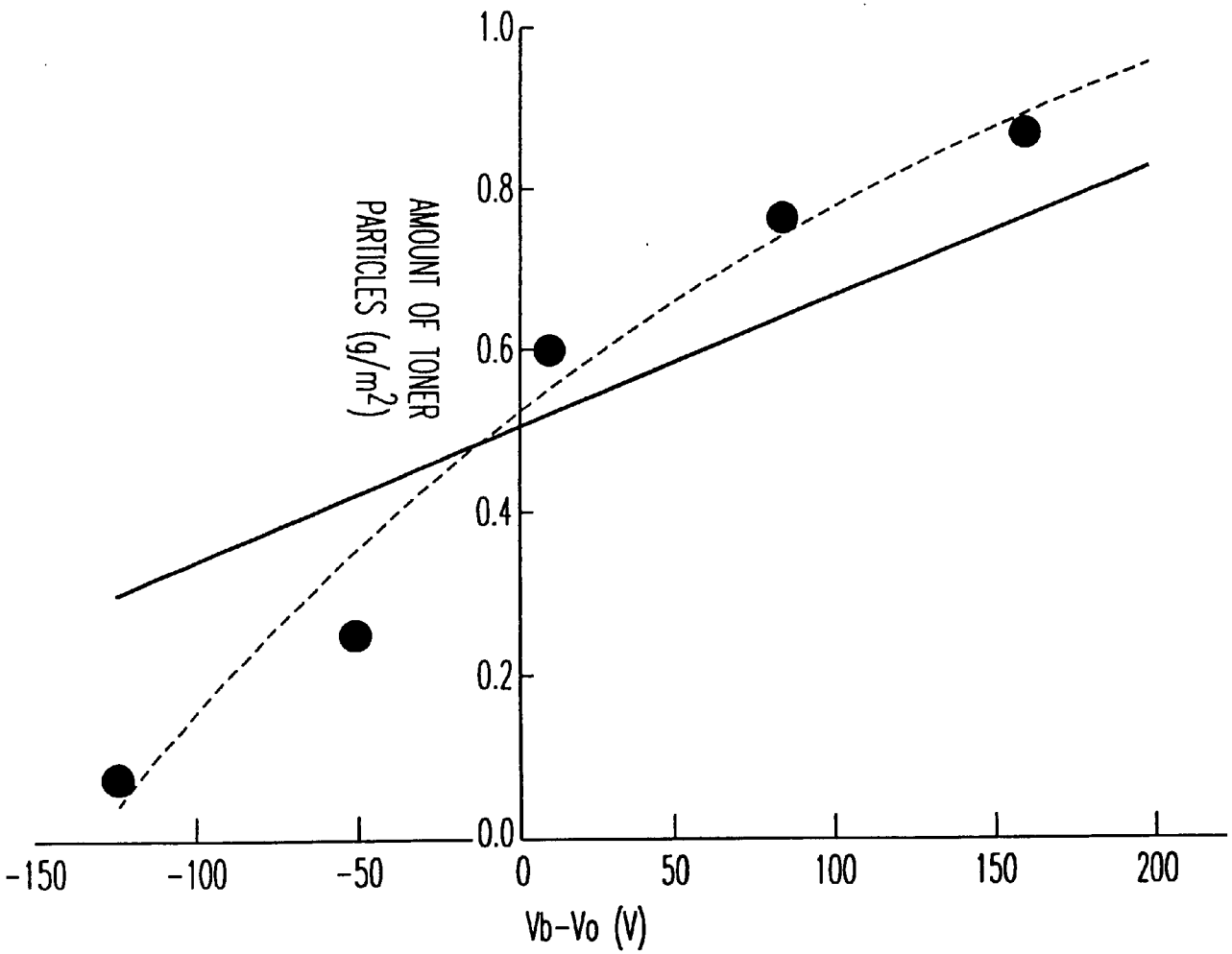
FIG. 10 is a graph for explaining a development characteristic of the liquid developer image forming apparatus according to the first embodiment of the present invention.

FIG. 10 is a graph showing development characteristic obtained by the analysis. The vertical axis of FIG. 10 shows amount of toner particles adhered to the photosensitive layer. The solid line in FIG. 10 shows a result of the analysis and the broken line in FIG. 10 shows an experimental data, and the difference is not substantial to obtain high text images.

Figure 11:
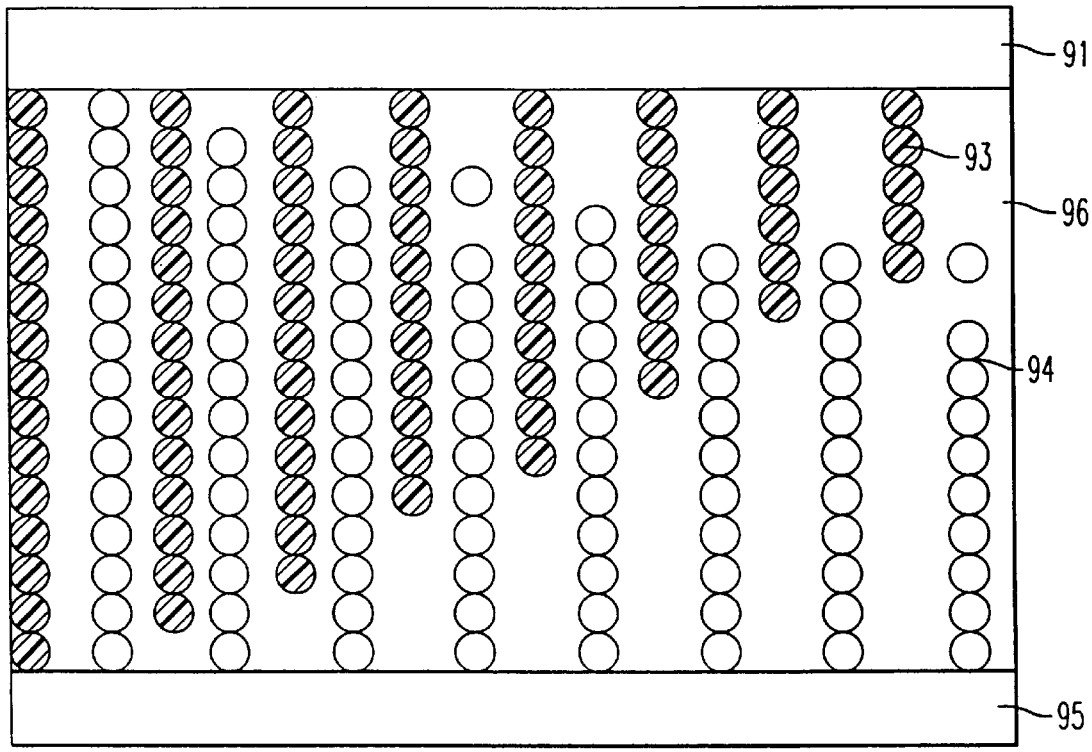
FIG. 11 is a graph showing movement of toner particles during the development using the liquid developer according to the first embodiment of the present invention.

FIG. 11 is a graph showing movement of toner particles during the development of the present embodiment and the graph shows locations of toner particles 93 and counter ions 94 in the liquid developer between the photosensitive layer 71 of latent image retaining body and the developing roller 5-1*b*. The left side of the graph correspond to initiation of development and the right side of the graph correspond to a later part of development. At the initiation of development, toner particles are uniformly distributed in the carrier solvent 93 and the positive and negative electric charges affect each other and move to respective sides at respective speed as the development advances, so that the toner particles 93 adhere to the photosensitive layer 71 and counter ions 94 move to the developing roller 5-1*a*. The analysis including the change of distribution of electric charge visualizes movement of toner particles in the liquid solvent.

A condition of successive color image development without peeling off a previous color image from the photosensitive layer is also studied as below.

The most possible situation of the peeling off of previous color image is that the previous image is formed on a region of photosensitive layer where the non-image region of the successive color image is formed. In such situation, the toner particles adhered to the photosensitive layer may receive Coulomb force that peels off the toner particles from the photosensitive layer.

Figure 12:
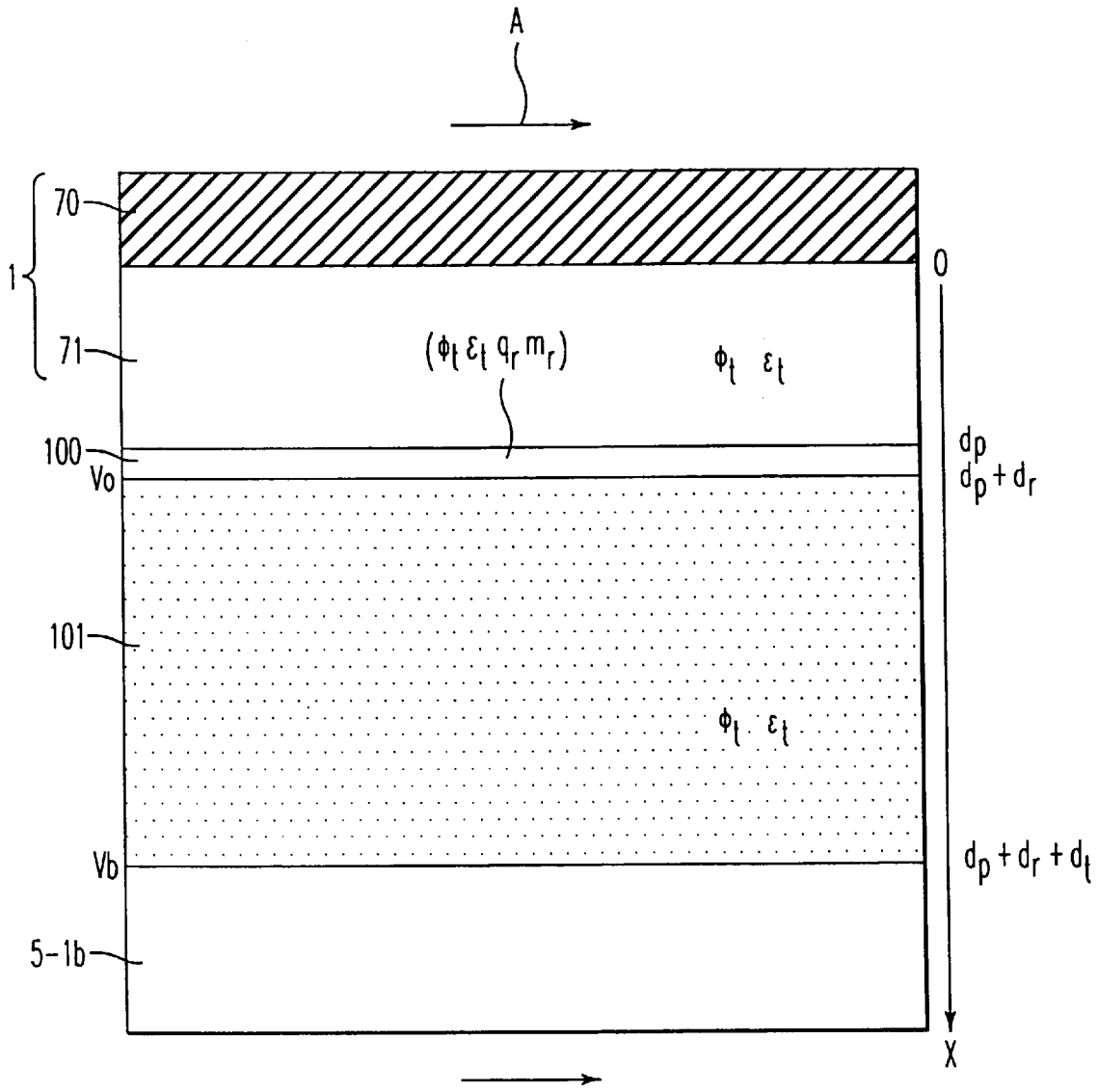
FIG. 12 is a diagram for explaining theoretical analysis of the development using the liquid developer according to the first embodiment of the present invention.

FIG. 12 is a diagram for explaining the Coulomb force applied to the toner particles on the photosensitive layer at the second development station.

The following are Poisson's equations for the photosensitive layer (5), yellow toner particles (6), and magenta toner particles (7).

$$\frac{d^2\Phi_p}{dx^2}=0 \tag{5}$$

$$\frac{d^2\Phi_r}{dx^2}=-\frac{q_r m_r}{\varepsilon_r d_r} \tag{6}$$

$$\frac{d^2\Phi_1}{dx^2}=0 \tag{7}$$

Those equations are put under following boundary conditions.

$$\varepsilon_p\frac{d\Phi_p(0)}{dx}=-\sigma_b \tag{8}$$

$$\varepsilon_r\frac{d\Phi_r(d_p)}{dx}-\varepsilon_p\frac{d\Phi_p(d_p)}{dx}=-\sigma_p \tag{9}$$

$$\varepsilon_t\frac{d\Phi_t(d_p+d_r)}{dx}-\varepsilon_r\frac{d\Phi_r(d_p+d_r)}{dx}=0 \tag{10}$$

$$\varepsilon_t\frac{d\Phi_t(_p+d_r+d_t)}{dx}=\sigma_t \tag{11}$$

$$\phi_p(O)=O \tag{12}$$

$$\phi_p(d_p)=\phi_r(d_p) \tag{13}$$

$$\phi_r(d_p+d_r)=\phi_t(d_p+d_r) \tag{14}$$

$$\phi_t(d_p)+d_r+d_t)=V_b \tag{15}$$

An electric potential difference $$-\frac{d\Phi_r}{dx}$$

inside the yellow toner layer on the photosensitive layer is obtained from a following equation (16).

$$-\frac{d\Phi_r}{dx}=\frac{q_r m_r}{\varepsilon_r d_r}\left(x-\frac{1}{A}\left(\frac{d_r}{m_r}\right)\left(-\frac{V_0-V_b}{q_r}+\left(\frac{d_r}{2\varepsilon_r}+\frac{d_t}{\varepsilon_t}\right)m_r\right)-d_p\right) \tag{16}$$

$$A=\frac{d_p}{\varepsilon_p}+\frac{d_r}{\varepsilon_r}+\frac{d_t}{\varepsilon_t} \tag{17}$$

Where $q_r$[C/kg] is a density of electrical charge of Yellow toner particles, $m_r$ [kg/m$^2$] is an area density of Yellow toner particles, $\epsilon_r$ is a relative dielectric constant of Yellow toner particles, $d_r$ [m] is a film thickness of Yellow image layer 100 of FIG. 12, x is a distance from the base layer 70 of latent image retaining body 1 of FIG. 12 in a direction to the developing roller 5-1*b*, $V_0$ is a surface electrical potential of the photosensitive layer, $V_b$ [V] is a surface electrical potential of the developing roller, $d_t$ [m] is a thickness of liquid solvent of the Magenta liquid developer, $\epsilon_t$ is a relative dielectric constant of the Magenta color liquid developer, and $d_p$ [m] is a film thickness of the photosensitive layer.

A force F that is effective to Yellow toner particles is shown as following equation (18), where $F_e$ is Coulomb force affecting the Yellow toner particles, $F_a$ is an inside adhesion force of Yellow toner particles, r [m] is an average radius of toner particles, $\rho_m$ [kg/m$^3$] is an average volume density of Yellow toner particles, and $q_r$ [C/kg] is a density of electrical charge of Yellow toner particles.

$$F=F_e-F_a=\frac{4\pi r^3\rho_m q_r}{3}\left(-\frac{q_r m_r}{\varepsilon_r d_r}\left(x-\frac{1}{A}\frac{d_r}{m_r}\left(-\frac{V_0-V_b}{q_r}+\left(\frac{d_r}{2\varepsilon_r}+\frac{d_t}{\varepsilon_t}\right)m_r\right)-d_p\right)\right)-F_a \tag{18}$$

The Yellow image is separated at distance $x_0$ where F is equal to 0, and the Yellow toner particles located at x that are further off than $x_0$ ($x>x_0$) are peeled off and mixed with the Magenta color developer. In other word, when ($d_p+d_r$) is equal to or smaller than $x_0$, the peeling off of the previous color image will be sufficiently prevented.

From equation (18), $x_0$ is expressed by an equation (19), and an amount of residual Yellow toner particles $m_x$ on the photosensitive layer per unit surface is expressed by an equation (20), as follows:

$$X_0 = \frac{3\varepsilon_r d_r}{4\pi r^3 \rho_m q_r^2 m_{r3}} F_a + \frac{1}{A}\frac{d_r}{m_r}\left(-\frac{V-V_b}{q_r} + \left(\frac{d_r}{2\varepsilon_r} + \frac{d_t}{\varepsilon_t}\right)m_r\right) + d_p \tag{19}$$

$$m_x = m_r\left(\frac{X_0 - d_p}{d_r}\right) = \frac{3\varepsilon_r}{4\pi^3 \rho_m q_r^2} F_a + \frac{1}{A}\left(-\frac{V_0 - V_b}{q_r} + \left(\frac{d_r}{2\varepsilon_r} + \frac{d_t}{\varepsilon_t}\right)m_r\right) \tag{20}$$

Figure 13:
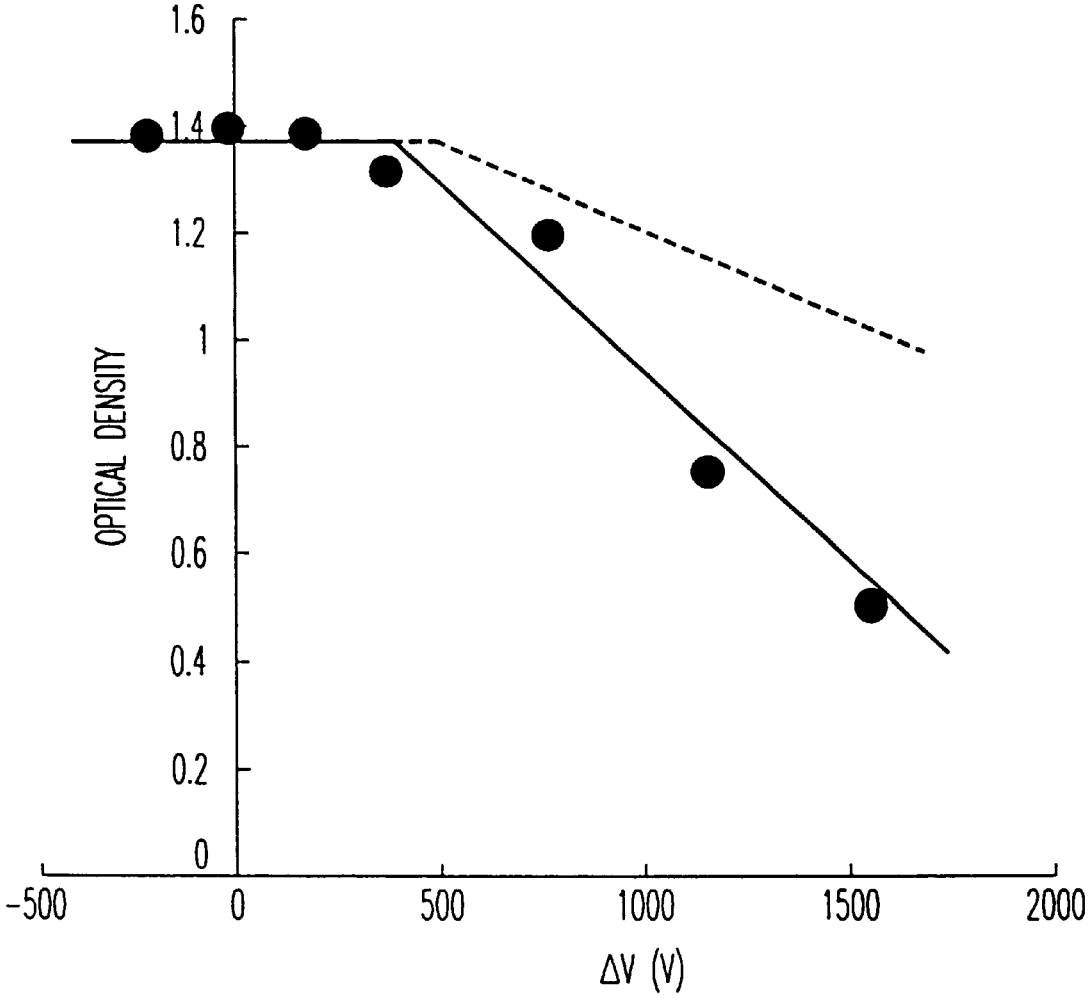
FIG. 13 is a graph for comparing results of experiment and the theoretical analysis according to the first embodiment of the present invention.

A solid line in FIG. 13 is obtained by calculation of relation between $\Delta V$ ($=V_0-V_b$) and $D_y$, where $m_x$ is assumed to be proportional to an optical density Dy of yellow toner image. Seven dots in FIG. 13 are experimental data and show substantial consistency with the solid line corresponding to the analytical data.

As for the several physical constants in the equations, the film thickness of photosensitive layer $d_p$ is $30\times10^{-6}$ [m], the film thickness of Yellow toner image $d_r$ is $2\times10^{-6}$ [m], the thickness of Magenta liquid developer $d_t$ is $148\times10^{-6}$ [m], the relative dielectric constant of the photosensitive layer $\epsilon_p$ is equal to ($12\times\epsilon_0$), the relative dielectric constant of Yellow toner particle $\epsilon_r$ is equal to ($1.2\times\epsilon_0$), and the relative dielectric constant of Magenta liquid developer $\epsilon_t$ is equal to ($2.03\times\epsilon_0$), where $\epsilon_0$ is a dielectric constant of vacuum. As well as for the several physical constants in the equations, the adhesion density per unit area $m_r$ of Yellow toner particles is equal to $1\times10^{-3}$ [kg/m$^2$], the charged amount of Yellow toner particle $q_r$ is equal to $230\times10^{-3}$ [C/kg], and a volume density of Yellow toner particles $\rho_m$ is equal to $1.4\times10^3$ [kg/m$^2$].

The parameters are derived as respective realistic finite values through the analysis and a characteristic of peeling off was calculated. A broken line in FIG. 13 corresponds to a result of characteristic of peeling off. The parameters of the relative dielectric constant $\epsilon_p$, and the dielectric constant $\epsilon_r$ are set at their lower limits ($1\times\epsilon_0$), the relative dielectric constant $\epsilon_t$ is set at its upper limit ($6.0\times\epsilon_0$), and the density of electric charge of Yellow toner particles $q_r$ is set at $530\times10^{-3}$ [C/kg]. Through the analysis, several characteristic curved lines corresponding with several inside adhesion forces Fa are obtained, and a lower limit of the adhesion force ($8\times10^{-9}$ [N]) which is enough to suppress the peeling off of the first toner image until a realistic upper limit of potential difference 500 [V] is obtained.

The inside adhesion force Fa can not have a broader range below ($8\times10^{-9}$ [N]) and the lower limit of the adhesion force Fa is very near its upper limit both from a theoretical approach and an experimental approach, which means the Coulomb force Fe which affects the peeling off of the first color image from the latent image retaining body should not be more than $8\times10^{-9}$ [N]. In other words, $\rho_m$, $m_r$, r, and $d_t$ should be fixed to obtain Fe which is equal to or lower than $8\times10^{-9}$ [N] at the surface of the first color image, where x is equal to ($d_p+d_r$), so that the peeling off of the first color image is substantially prevented.

An appropriate Coulomb force Fe which affects Magenta toner particles in the second liquid developer in a direction toward the developing roller at the surface of the first color image should also be maintained so as to prevent its adhesion on the first color image. At a limiting condition, in which the electrical potential difference $\Delta V$ is it's lower limit (100 [V]), the lowest value of the electrical charge of Magenta toner particles contacting the Yellow toner layer is $40\times10^{-3}$ [C/kg], the three relative dielectric constants $\epsilon_p$, $\epsilon_t$, and $\epsilon_r$ are equal to respective limiting values ($\epsilon_p=\epsilon_t=1\times\epsilon_0$, $\epsilon_r=2\times\epsilon_0$), and the amount of electrical charge of first toner particles $q_r$ is the lowest limit $40\times10^{-3}$ [C/kg], $1\times10^{-11}$ [N] is the lowest value for Fa for preventing the adhesion of the Magenta toner particles on the Yellow image layer.

Therefore the Coulomb Force Fe should be $1\times10^{-11}$ [N] or more at the surface of first color image.

The following equations (21) and 22 show several conditions mentioned above which are effective to obtain appropriate liquid developer IOI process.

$$1\times10^{-11}[N] \le \frac{4\pi r^3 \rho_m q_r}{3}\left(-\frac{q_r m_r}{\varepsilon_r d_r}\left(d_r - \frac{1}{A}\frac{d_r}{m_r}\left(-\frac{\Delta V}{q_r} + \left(\frac{d_r}{2\varepsilon_r} + \frac{d_t}{\varepsilon_t}\right)m_r\right)\right)\right) \le 8\times10^{-9}[N] \tag{21}$$

$$A = \frac{d_p}{\varepsilon_p} + \frac{d_r}{\varepsilon_r} + \frac{d_t}{\varepsilon_t} \tag{22}$$

In the above description, the Yellow and Magenta liquid developers are used as respective first and second color developer, the above equations (21) and (22) are applicable to any color of liquid developers to be used so that various liquid color developers may be used consistent with equations (21) and (22) to obtain an appropriate IOI image.

The several parameters may be measured in an actual process by methods that are well known in the art, and following discussion describes one of the methods which may be used.

The volume density $\rho_m$ [kg/m$^3$] of Yellow toner particles at the second development station can be measured as an approximation value of a density of solid portions of the liquid developer. The density of solid portions of liquid developer can be measured by weight and volume of a substantially dried solid portion that can be obtained after evaporation of solvent from the liquid developer. The surface density $m_r$ [kg/m$^2$] can be obtained through measurement of weight of Yellow image at the second development station. The Yellow image at the second development station can be obtained by removing it with an unwoven cloth and then the solvent can be evaporated. The density may be obtained by dividing the weight by the area of the removed Yellow image. The electrical charge $q_r$ [C/kg] can be measured by dividing current, that is an integrated value obtained through electrophoresis of toner particles of liquid developer disposed between a parallel monotonous electrodes, by a weight of whole toner particles moved through electrophoresis. The distance between two electrodes of the parallel monotonous electrodes is about 180 $\mu$m, and an effective area of the parallel monotonous electrodes receiving the liquid developer is about 5 cm$^2$, therefore an approximate amount of liquid developer received by the parallel monotonous electrodes is about 180 [$\mu$m]×5 [cm$^2$]. The current I can be measured by using an electrical potential difference of about 180 [V] applied between the two electrodes. An integrated current may include a background current Ib, which flows even after the electrophoretic movement of all toner particles ends, therefore the background current Ib should be subtracted from the integrated volume of the current. The weight of the moved toner particles is measured after removing toner particles with solvent adhered to one of the electrodes to which the toner particles adhered and drying the toner particles by evaporating the solvent.

The relative dielectric constant $\epsilon_r$ [C$^2$/Nm$^2$] can be measured by using the solvent removed toner particles. The thickness of the first color image $d_r$ [m] is measured by using $m_r$. For example, by preparing a dry toner layer having an average thickness of 1 [mm], adding a solvent to the dry toner layer and measuring the change of thickness, the thickness of the first color image $d_r$ [m] can be obtained by the change of thickness and the surface density $m_r$ [kg/m$^2$].

The relative dielectric constant of photosensitive layer $\epsilon_p$ [C$^2$/Nm$^2$], the thickness of photosensitive layer $d_p$ [m], and the development voltage at second color development station $\Delta V$ [V] are respectively measured by using dielectric constant measuring device, a Micrometer, and a voltmeter. The thickness of the second liquid developer at the second development station $d_t$ [m] can be obtained by subtracting the thickness $d_r$ from the developing gap $d_g$ at the developing station. Because a percentage of toner particles in the liquid developer is lower than several percentages, the relative dielectric constant $\epsilon_t$ [C$^2$/Nm$^2$] is substantially equal to the relative dielectric constant of the carrier solvent. If more toner particles are added to the solvent, the relative dielectric constant $\epsilon_t$ of the liquid developer should be measured.

Figure 14:
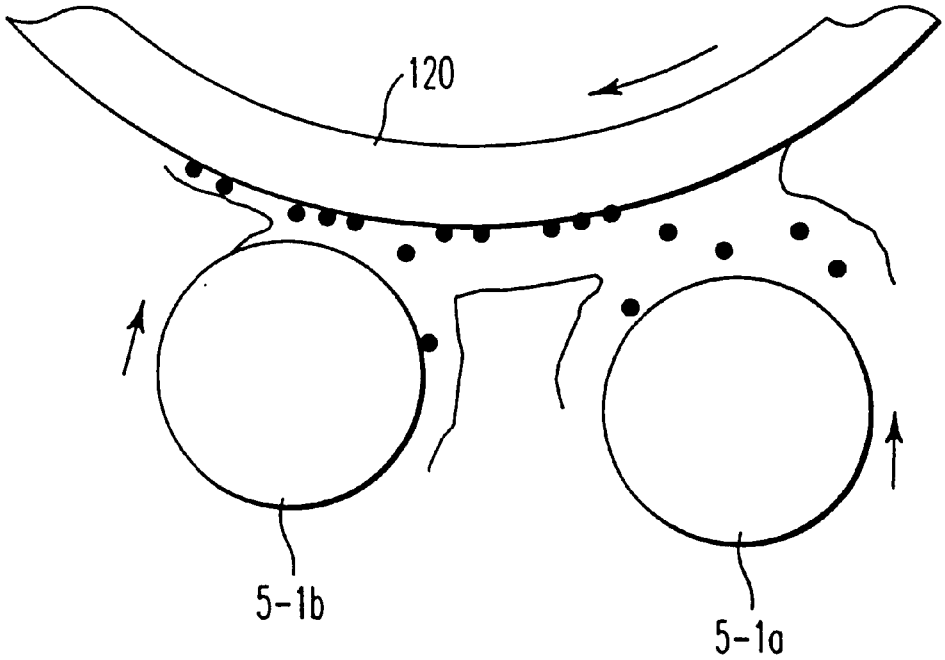
FIG. 14 is a cross-sectional view of developing and squeezing stations of a liquid developer image forming apparatus according to a second embodiment of the present invention.

FIG. 14 is a schematic cross-sectional view of developing and squeezing stations where an effective surface of latent image retaining body 1 faces the developing roller 5-1*a* and the squeezing roller 5-1*b*.

The squeezing roller 5-1*b* is supported to rotate so that its surface moves in a same or reverse direction of surface movement of latent image retaining body 1 at the squeezing station, and removes a solvent from the effective surface of latent image retaining body 1. The squeezing roller 5-1*b* may be provided with a certain electrical potential that is between the electrical potentials of non-image and image regions so as to repel toner particles flowing around or adhered to the non-image region of the effective surface.

The Coulomb force applied by the electrical potential difference between the effective surface and the squeezing roller may also affect the image on the effective surface.

The several parameters disclosed in the first embodiment, such as $\rho_m$ [kg/m$^3$], $d_r$ [m], $\epsilon_r$ [C$^2$/Nm$^2$], $q_r$ [C/kg], $m_r$ [kg/m$^2$], and r [m], can be respectively replaced with parameters of the developed image at the squeezing station, namely a volume density $\rho_{om}$ [kg/m$^3$], an area density $m_{0r}$ of the image [kg/m$^2$], an electrical charging density $q_{0r}$ [C/kg], a relative dielectric constant $\epsilon_{0r}$ [C$^2$/Nm$^2$], a thickness $d_{0r}$ [m]. The electrical potential difference $\Delta V_1$ [V] between the effective surface of latent image retaining body 1 and the squeezing roller 5-1*b*, a thickness of liquid developer at the squeezing station $d_{0t}$ [m], and a relative dielectric constant $\epsilon_{0t}$ [C$^2$/Nm$^2$] of liquid developer at the squeezing station are also used in place of the electrical potential difference $\Delta V$ [V], the thickness $d_t$ [m], and the dielectric constant $\Delta_t$ [C$^2$/Nm$^2$]. Therefore equations (21) and (22) can be modified as following equations (23) and (24).

$$6\times10^{-11}[N] \le \frac{4\pi r^3 \rho_{0m} q_{0r}}{3}\left(-\frac{q_{0r}m_{0r}}{\varepsilon_{0r}d_{0r}}\left(d_{0r}-\frac{1}{A}\frac{d_{0r}}{m_{0r}}\left(-\frac{\Delta V}{q_{0r}}+\left(\frac{d_{0r}}{2\varepsilon_{0r}}+\frac{d_t}{\varepsilon_t}\right)m_{0r}\right)\right)\right) \le 3\times10^{-9}[N] \tag{23}$$

$$A = \frac{d_p}{\varepsilon_p}+\frac{d_{0r}}{\varepsilon_{0r}}+\frac{d_t}{\varepsilon_t} \tag{24}$$

The reason that the upper limit of equation (23) is lower than that of the equation (21) is that the developed image at the squeezing station has thresholds of peeling off lower than that of the development station discussed in the first embodiment. The developed image at the squeezing station usually contains more solvent than the image at the succeeding development station; therefore the adhesive force between the toner particles at the squeezing station is lower than the succeeding development station.

The reason that the lower limit of equation (23) is higher than that of the equation (21) is that the squeezing roller has applied thereto with an appropriate electrical potential to fix the toner particles onto the photosensitive layer.

The several parameters used in the second embodiment may be measured by similar methods described in regard to the first embodiment, or their equivalents.

According to the embodiments of the present invention, the present invention provides a liquid developer image developing apparatus and an image forming method that can maintain and produce a high text color image at high speed.

Whereas the present invention has been particularly shown and described with reference to preferred embodiments thereof, it will be understood by those skilled in the art that various other changes in the form and details may be made therein without departing from the spirit and scope of the invention.

What is desired to be secured by letters patent of the United States is:

1. A liquid developer image forming apparatus, using first, second, third and fourth liquid developers respectively containing a solvent and a plurality of toner particles, comprising;

a latent image retaining body comprising a photosensitive layer, the photosensitive layer configured to keep a latent image and have a relative dielectric constant $\epsilon_p$ [C$^2$/Nm$^2$] and an average thickness $d_p$ [m];

a first developing surface facing the latent image retaining body at a first developing station, supplied with an electrical potential for a first development, and configured to provide the first liquid developer to the latent image retaining body retaining a first latent image;

a latent image forming unit facing the latent image retaining body and configured to form a second latent image comprising image and non-image regions of the photosensitive layer supporting an image of the first liquid developer; and a second developing surface facing the latent image retaining body at a second development station and supplied with an electrical potential for a second development, the electrical potential for the second development having an electrical potential difference $\Delta V$ from an electrical potential of the non-image region of the second latent image, the second developing surface configured to provide the second liquid developer to the latent image retaining body supporting the image of the first liquid developer and the second latent image, the plurality of toner particles of the first liquid developer at the second development station having a volume density of toner particles $p_m$ [kg/m$^3$], a surface density $m_r$ [kg/m$^2$], a relative dielectric constant $\epsilon_r$ [C$^2$/Nm$^2$], an average radius r [m], and a density of electrical charge $q_r$ [C/kg], the first image having an average thickness $d_r$ [m] at the second development station, the second liquid developer having an average thickness dt [m] at the second development station, and a relative dielectric constant $\epsilon_t$ [C$^2$/Nm$^2$], wherein the following equations are satisfied;

$$1\times10^{-11}[N] \le \frac{4\pi r^3 \rho_m q_r}{3}\left(-\frac{q_r m_r}{\varepsilon_r d_r}\left(d_r-\frac{1}{A}\frac{d_r}{m_r}\left(-\frac{\Delta V}{q_r}+\left(\frac{d_r}{2\varepsilon_r}+\frac{d_t}{\varepsilon_t}\right)m_r\right)\right)\right) \le 8\times10^{-9}[N],$$

$$\text{and } A = \frac{d_p}{\varepsilon_p}+\frac{d_r}{\varepsilon_r}+\frac{d_t}{\varepsilon_t}.$$

a third developing surface facing the latent image retaining body at a third developing station, supplied with an electrical potential for a third development, and configured to provide, the third liquid developer to the latent image retaining body supporting an image of the first and second liquid developers and retaining a third latent image; and a fourth developing surface facing the latent image retaining body at a fourth developing station, supplied with an electrical potential for a fourth development, and configured to provide the fourth liquid developer to the latent image retaining body supporting an image of the first, second and third liquid developers and retaining a fourth latent image.

2. The apparatus of claim 1, wherein the electrical potential difference $\Delta V$ is 500 [V] or less.

3. The apparatus of claim 2, wherein the relative dielectric constant $\epsilon_p$, and $\epsilon_r$, are above $1\times\epsilon_0$, where $\epsilon_0$ is a dielectric constant of vacuum, the relative dielectric constant $\epsilon_t$ is $6.0\times\epsilon_0$ or more, and the density of electrical charge $q_r$ is $530\times10^{-3}$ [C/kg] or less.

4. The apparatus of claim 1, wherein the electrical potential difference $\Delta V$ is 100 [V] or less.

5. The apparatus of claim 4, wherein the density of electrical charge $q_r$ is $40\times10^{-3}$ [C/kg] or more, the relative dielectric constant $\epsilon_p$ is $1\times\epsilon_0$ or more, where $\epsilon_0$ a dielectric constant of vacuum, the relative dielectric constant $\epsilon_t$ is $1\times\epsilon_0$ or more, and the relative dielectric constant $\epsilon_r$ is $2\times\epsilon_0$ or more.

6. The apparatus of claim 1, further comprising a transfer unit coupled to the latent image retaining body at a first transfer station and configured to transfer a composite image of the first, second, third and fourth liquid developers to a final substrate.

7. The apparatus of claim 6, wherein the transfer unit comprising an intermediate transfer surface coupled to the latent image retaining body at a first transfer station and the final substrate at a second transfer station.

8. The apparatus of claim 7, wherein a pressure is provided between the transfer surface and the latent image retaining body at the first transfer station.

9. The apparatus of claim 8, further comprising a solvent suction unit disposed between the fourth developing station and the first transfer station and configured to suction the solvent on the latent image retaining body supporting the composite image of the first, second, third and fourth liquid developers.

10. The apparatus of claim 8, further comprising a drying unit disposed between the fourth developing station and the first transfer station and configured to dry the composite image on the latent image retaining body supporting the composite image of the first, second, third and fourth liquid developers.

11. An image developing method, comprising;

providing a first liquid developer on a latent image retaining body at a first developing station, the latent image retaining body having a photosensitive layer, the photosensitive layer retaining a first latent image having image and non-image regions, the first liquid developer comprising a solvent and a plurality of toner particles, the photosensitive layer having a relative dielectric constant $\epsilon_p$ [$C^2/Nm^2$] and an average thickness $d_p$ [m ];

forming a second latent image on the photosensitive layer retaining an image of the first liquid developer, the second latent image having image and non-image regions, providing a second liquid developer on the latent image retaining body by means of a developing surface at the second development station, the toner particles of the first liquid developer at the second development station having a volume density $p_m$ [$kg/m^3$], a relative dielectric constant $\epsilon_r$ [$C^2/Nm^2$], an average radius r [m], a density of electric charge $q_r$ [C/kg], and a surface density mr [$kg/m^2$], the image of the first liquid developer at the second development station having an average thickness $d_r$ [m], the second liquid developer having an average thickness $d_t$ [m] at the second development station and a relative dielectric constant $\epsilon_r$ [$C^2/Nm^2$], the electrical potential of the non-image region of the second latent image having an electrical potential difference $\Delta V$ [V] from an electrical potential of the development surface, wherein the following equations are satisfied, $$1\times10^{-11}[N] \le \frac{4\pi r^3\rho_m q_r}{3}\left(-\frac{q_r m_r}{\varepsilon_r d_r}\left(d_r - \frac{1}{A}\frac{d_r}{m_r}\left(-\frac{\Delta V}{q_r} + \left(\frac{d_r}{2\varepsilon_r} + \frac{d_t}{\varepsilon_t}\right)m_r\right)\right)\right) \le 8\times10^{-9}[N],$$

$$\text{and } A = \frac{d_p}{\varepsilon_p} + \frac{d_r}{\varepsilon_r} + \frac{d_t}{\varepsilon_t}.$$

providing a third liquid developer on the latent image retaining body supporting an image of the first and second liquid developers and retaining a third latent image, and providing a fourth liquid developer on the latent image retaining body supporting an image of the first, second and third liquid developers and retaining a fourth latent image.

12. The method of claim 11, wherein the electrical potential difference $\Delta V$ is 500 [V] or less.

13. The method of claim 12, wherein the relative dielectric constant $\epsilon_p$ and $\epsilon_r$ are above $1\times\epsilon_0$, where $\epsilon_0$ is a dielectric constant of vacuum, the relative dielectric constant $\epsilon_t$ is $6.0\times\epsilon_0$ or more, and the density of electrical charge $q_r$ is $530\times10^{-3}$ [C/kg] or less.

14. The method of claim 11, wherein the electrical potential difference $\Delta V$ is 100 [V] or less.

15. The method of claim 14, wherein the density of electrical charge $q_r$ is $40\times10^{-3}$ [C/kg] or more, the relative dielectric constant $\epsilon_0$ is $1\times\epsilon_0$ or more, where $\epsilon_0$ is a dielectric constant of vacuum, the relative dielectric constant $\epsilon_t$ is $1\times\epsilon_0$ or more, and the relative dielectric constant $\epsilon_r$ is $2\times\epsilon_0$ or more.

16. The method of claim 11, further comprising a step of transferring a composite image of the first, second, third and fourth liquid developers from the latent image retaining body to a final substrate.

17. The method of claim 16, comprising first transferring the composite image from the latent image retaining body to an intermediate transfer surface, and second transferring the composite image from the intermediate transfer surface to the final substrate.

18. The method of claim 17, comprising performing the step of first transferring the composite image from the latent image retaining body to the intermediate transfer surface with a pressure.

19. The method of claim 18, further comprising a step of suctioning solvent on the latent image retaining surface supporting the composite image of the first, second, third and fourth liquid developers before transferring the composite image to the intermediate transfer surface.

20. The method of claim 18, further comprising a step of drying the composite image of the first, second, third and fourth liquid developers on the latent image retaining body before transferring the composite image to the intermediate transfer surface.

21. The method of claim 11, wherein the first liquid developer contains yellow color, the second liquid developer contains magenta color, the third liquid developer contains cyan color, and the fourth liquid developer contains black color.

* * * * *